US007705869B2

(12) United States Patent
Tsujino et al.

(10) Patent No.: US 7,705,869 B2
(45) Date of Patent: Apr. 27, 2010

(54) LIGHT SHIELDING MEMBER, A LINE HEAD AND AN IMAGE FORMING APPARATUS USING THE LINE HEAD

(75) Inventors: Kiyoshi Tsujino, Matsumoto (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 47 days.

(21) Appl. No.: 12/117,626

(22) Filed: May 8, 2008

(65) Prior Publication Data

US 2008/0284839 A1 Nov. 20, 2008

(30) Foreign Application Priority Data

May 14, 2007 (JP) ..... 2007-127653
Mar. 17, 2008 (JP) ..... 2008-067398

(51) Int. Cl.
*B41J 2/45* (2006.01)

(52) U.S. Cl. ..... 347/238

(58) Field of Classification Search ..... 347/238, 347/241–244, 256–258
See application file for complete search history.

(56) References Cited

U.S. PATENT DOCUMENTS 5,768,023 A * 6/1998 Sawaki et al. ..... 359/622
6,069,741 A * 5/2000 Osawa ..... 359/621
6,844,888 B2 * 1/2005 Nakamura ..... 347/138
2007/0025765 A1 * 2/2007 Akagawa et al. ..... 399/139

FOREIGN PATENT DOCUMENTS

JP 06-270468 9/1994
JP 11048526 A * 2/1999
JP 2006159492 A 6/2006
JP 2007062025 A 3/2007

OTHER PUBLICATIONS

European search report for corresponding European application 08008834.7-1251 lists the references above

* cited by examiner

*Primary Examiner*—Hai C Pham
(74) *Attorney, Agent, or Firm*—Hogan & Hartson LLP

(57) ABSTRACT

A line head, includes: a head substrate that includes a plurality of light emitting element groups as groups of light emitting elements; a lens array that includes a plurality of lenses each of which faces the corresponding light emitting element group in a first direction; and a light shielding member that is disposed between the head substrate and the lens array and includes a plurality of light shielding plates which are arranged side by side in the first direction while defining a space layer therebetween, wherein each of the plurality of light shielding plates is provided with a plurality of light guide holes penetrating in the first direction and facing the plurality of light emitting element groups in the first direction respectively, the plurality of light guide holes facing each of the light emitting element groups are arranged in the first direction respectively to form a plurality of light guide portions, and lights from the plurality of light emitting element groups are incident on the plurality of lenses through the plurality of light guide portions respectively.

11 Claims, 15 Drawing Sheets

| | |
|---|---|
| COMPARATIVE EXAMPLE |  |
| EMBODIMENT |  |

LIGHT SHIELDING MEMBER, A LINE HEAD AND AN IMAGE FORMING APPARATUS USING THE LINE HEAD

CROSS REFERENCE TO RELATED ART

The disclosure of Japanese Patent Applications No. 2007-127653 filed on May 14, 2007 and No. 2008-67398 filed on Mar. 17, 2008 including specification, drawings and claims is incorporated herein by reference in its entirety.

BACKGROUND

1. Technical Field

The invention relates to a light shielding member used in a line head, a line head for scanning a surface of a latent image carrier to be scanned with light, and an image forming apparatus.

2. Related Art

A line head for forming a latent image by scanning a surface-to-be-scanned of a photosensitive member as a latent image carrier with light is used as a light source of an electrophotographic printer as an image forming apparatus. As, for example, disclosed in JP-A-6-270468, an optical printer head as a line head is proposed to use light emitting element groups ("LED arrays" in JP-A-6-270468) formed by arraying a plurality of light emitting diode devices (hereinafter, LEDs) as light emitting elements. In the line head disclosed in JP-A-6-270468, a plurality of light emitting element groups are arranged side by side and a plurality of imaging lenses are arranged to face the plurality of light emitting element groups in a one-to-one correspondence. There is also known a construction for reducing a phenomenon where lights from the LED arrays leak to the adjacent LED arrays or to the outside to cause the blurring and the like of the latent image, so-called crosstalk by arranging light shielding plates as light shielding members between the LED arrays.

SUMMARY

Lights emitted from the light emitting elements are imaged by the imaging lenses facing the light emitting element groups to form spots corresponding to the light emitting elements on the surface-to-be-scanned. Here, when the optical magnification of the imaging lens is, for example, 0.5, the amount of the light directly propagating from the light emitting element to the imaging lens is about 2.5% of the amount of the light emitted from the light emitting element. The remaining light becomes the cause of crosstalk and stray light. The crosstalk can be reduced by the light shielding member arranged between the light emitting element and the imaging lens. However, the light reflected by the light shielding member itself is incident on the imaging lens at various incidence angles, thereby propagating toward positions largely deviated from the position where a spot is supposed to be formed. These reflected lights as stray lights cause so-called ghost in an area outside the area where the spots are supposed to be formed. A latent image formed on the photosensitive member becomes unclear by the ghost, whereby the quality of an image obtained by the image forming apparatus also decreases.

An advantage of some aspects of the invention is to provide a light shielding member producing less stray light, a line head with a reduced occurrence of ghost using the light shielding member and an image forming apparatus with a smaller reduction in image quality using the line head.

According to a first aspect of the invention, there is provided a line head, comprising: a head substrate that includes a plurality of light emitting element groups as groups of light emitting elements; a lens array that includes a plurality of lenses each of which faces the corresponding light emitting element group in a first direction; and a light shielding member that is disposed between the head substrate and the lens array and includes a plurality of light shielding plates which are arranged side by side in the first direction while defining a space layer therebetween, wherein each of the plurality of light shielding plates is provided with a plurality of light guide holes penetrating in the first direction and facing the plurality of light emitting element groups in the first direction respectively, the plurality of light guide holes facing each of the light emitting element groups are arranged in the first direction respectively to form a plurality of light guide portions, and lights from the plurality of light emitting element groups are incident on the plurality of lenses through the plurality of light guide portions respectively.

According to a second aspect of the invention, there is provided an image forming apparatus, comprising: a latent image carrier; and a line head that includes: a head substrate which has a plurality of light emitting element groups as groups of light emitting elements; a lens array which has a plurality of lenses each of which faces the corresponding light emitting element group in a first direction; and a light shielding member which is disposed between the head substrate and the lens array and has a plurality of light shielding plates which are arranged side by side in the first direction while defining a space layer therebetween, wherein the line head images lights emitted from the light emitting elements using the lenses to expose a surface of the latent image carrier, each of the plurality of light shielding plates is provided with a plurality of light guide holes penetrating in the first direction and facing the plurality of light emitting element groups in the first direction respectively, the plurality of light guide holes facing each of the light emitting element groups are arranged in the first direction respectively to form a plurality of light guide portions, and lights from the plurality of light emitting element groups are incident on the plurality of lenses through the plurality of light guide portions respectively.

According to a third aspect of the invention, there is provided a light shielding member, comprising: a plurality of light shielding plates that are provided with light guide holes penetrating in a first direction, and are arranged side by side in the first direction while defining a space layer therebetween such that the respective light guide holes are arranged side by side in the first direction, wherein the plurality of light guide holes that are arranged side by side in the first direction forms a light guide portion, and lights passes through the plurality of light shielding plates in the first direction by way of the light guide portion.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

Hereinafter, embodiments of the invention are described with reference to the drawings.

First Embodiment

Figure 1:
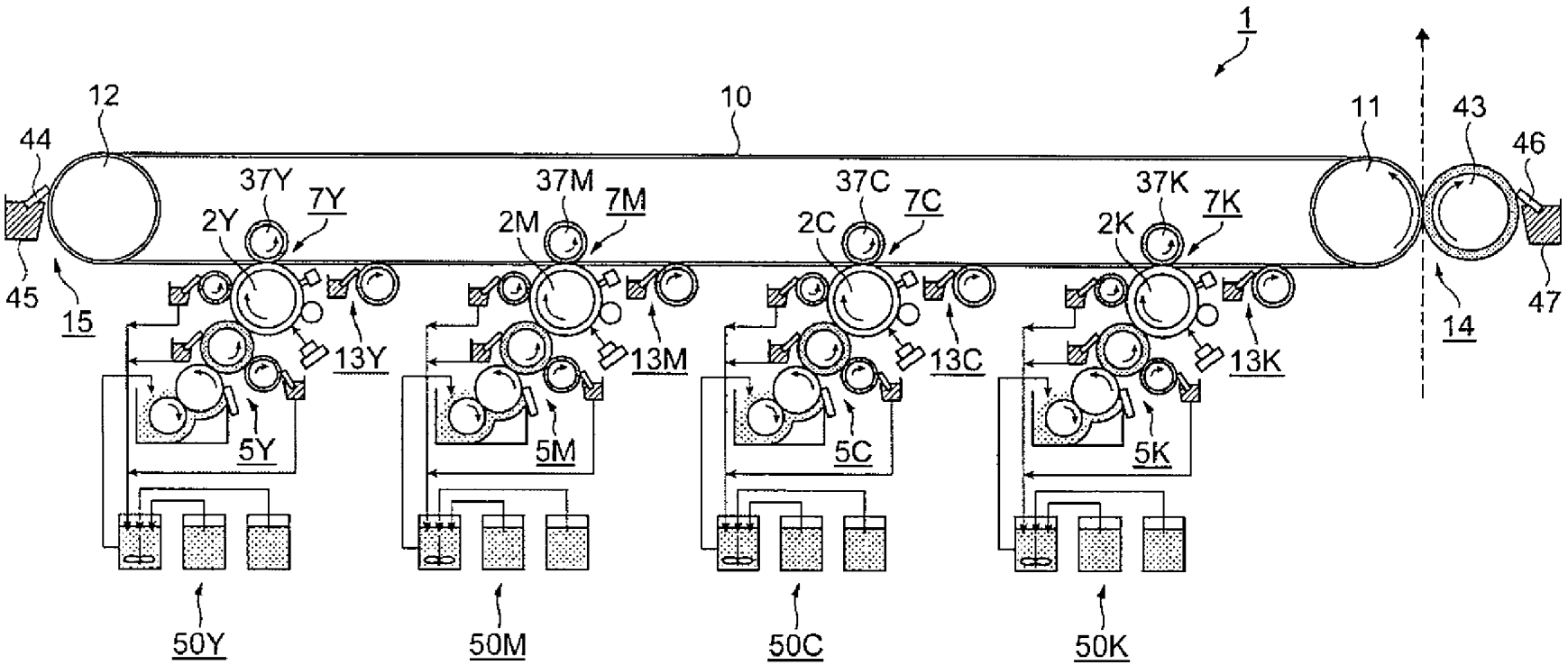
FIG. 1 is a diagram schematically and partly showing an image forming apparatus according to this embodiment.

FIG. 1 is a diagram schematically and partly showing an image forming apparatus 1 according to this embodiment. An image forming apparatus 1 is an apparatus for forming an image using a liquid developer, in which toner particles are dispersed in a liquid carrier. It should be noted that rotating directions are shown by solid-line arrows in rotational members. In FIG. 1, the image forming apparatus 1 includes an endless intermediate transfer belt 10 as an intermediate transfer medium, a drive roller 11 and a driven roller 12 on which the intermediate transfer belt 10 is mounted, a secondary transfer device 14, an intermediate transfer belt cleaning device 15 and primary transfer units. The primary transfer units include primary transfer units 50Y, 50M, 50C and 50K corresponding to the respective colors of yellow (Y), magenta (M), cyan (C) and black (K). In the following description, Y, M, C and K indicating the respective colors are affixed to the reference numerals of devices, members and the like corresponding to the respective colors.

Although not shown, the image forming apparatus 1 includes a transfer material storage device for storing transfer materials such as sheets and a pair of rollers for feeding and conveying a transfer material from the transfer material storage device to the secondary transfer device 14 at a side upstream of the secondary transfer device 14 in a transfer material conveying direction similar to a conventional general image forming apparatus for performing a secondary transfer. In FIG. 1, the conveying direction of the transfer material is shown by a broken-line arrow. This image forming apparatus 1 also includes a fixing device and a discharge tray at a side downstream of the secondary transfer device 14 in the transfer material conveying direction.

In FIG. 1, the intermediate transfer belt 10 is so mounted between a pair of the drive roller 11 and the driven roller 12 spaced apart from each other as to rotate counterclockwise. This intermediate transfer belt 10 is preferably an elastic intermediate transfer belt in order to improve the transfer efficiency of the secondary transfer to transfer materials such as sheets. Although the respective primary transfer units 50Y, 50M, 50C and 50K are successively arranged in this order from an upstream side in the rotating direction of the intermediate transfer belt 10 in the image forming apparatus 1, the arrangement order of the colors Y, M, C and K can be arbitrarily set. It should be noted that the intermediate transfer belt 10 can be replaced by an intermediate transfer drum.

The secondary transfer device 14 is disposed at a side of the intermediate transfer belt 10 toward the drive roller 11, and the intermediate transfer belt cleaning device 15 is disposed at a side of the intermediate transfer belt 10 toward the driven roller 12. The secondary transfer device 14 includes a secondary transfer roller 43. This secondary transfer roller 43 is for bringing a transfer material such as a sheet into contact with the intermediate transfer belt 10 mounted on the drive roller 11 to transfer a color toner image, in which toner images of the respective colors are superimposed, on the intermediate transfer belt 10 to the transfer material. In this case, the drive roller 11 also functions as a backup roller at the time of secondary transfer. Further, the secondary transfer device 14 includes a secondary transfer roller cleaner 46 and a secondary transfer roller cleaner collection liquid storage container 47. The secondary transfer roller cleaner 46 is made of an elastic material such as rubber. This secondary transfer roller cleaner 46 is held in contact with the secondary transfer roller 43 to remove the liquid developer residual on the outer surface of the secondary transfer roller 43 after the secondary transfer by scraping the liquid developer off. The secondary transfer roller cleaner collection liquid storage container 47 collects and stores the liquid developer scraped off from the secondary transfer roller 43 by the secondary transfer roller cleaner 46.

The intermediate transfer belt cleaning device 15 includes an intermediate transfer belt cleaner 44 and an intermediate transfer belt cleaner collection liquid storage container 45. The intermediate transfer belt cleaner 44 is held in contact with the intermediate transfer belt 10 to remove the liquid developer residual on the surface of the intermediate transfer belt 10 by scraping it off after the secondary transfer. In this case, the driven roller 12 also functions as a backup roller at the time of cleaning the intermediate transfer belt. This intermediate transfer belt cleaner 44 is made of an elastic material such as rubber. The intermediate transfer belt cleaner collection liquid storage container 45 is for collecting and storing the liquid developer scraped off from the intermediate transfer belt 10 by the intermediate transfer belt cleaner 44.

The respective primary transfer units 50Y, 50M, 50C and 50K include corresponding developing devices 5Y, 5M, 5C and 5K, primary transfer devices 7Y, 7M, 7C and 7K, photosensitive members 2Y, 2M, 2C and 2K as latent image carriers of yellow (Y), magenta (M), cyan (C) and black (K) arranged in series. Intermediate transfer belt squeezers 13Y, 13M, 13C and 13K are arranged near and downstream of the respective primary transfer devices 7Y, 7M, 7C and 7K in the rotating direction of the intermediate transfer belt 10.

Any of the respective photosensitive members 2Y, 2M, 2C and 2K is a photosensitive drum in the example shown in FIG. 1. Any of these photosensitive members 2Y, 2M, 2C and 2K is rotated clockwise as shown by solid-line arrows in FIG. 1 during the operation. It should be noted that the respective photosensitive members 2Y, 2M, 2C and 2K may be endless belts. The respective primary transfer devices 7Y, 7M, 7C and 7K include backup rollers 37Y, 37M, 37C and 37K for primary transfer for bringing the intermediate transfer belt 10 into contact with the respective photosensitive members 2Y, 2M, 2C and 2K.

The primary transfer units 50Y, 50M, 50C and 50K are described in detail below, taking the primary transfer unit 50Y as an example. The constituent parts of the primary transfer units 50M, 50C, 50K differ only in the respective colors M, C, K and the constructions and arrangements thereof are the same as those of the primary transfer unit 50Y.

Figure 2:
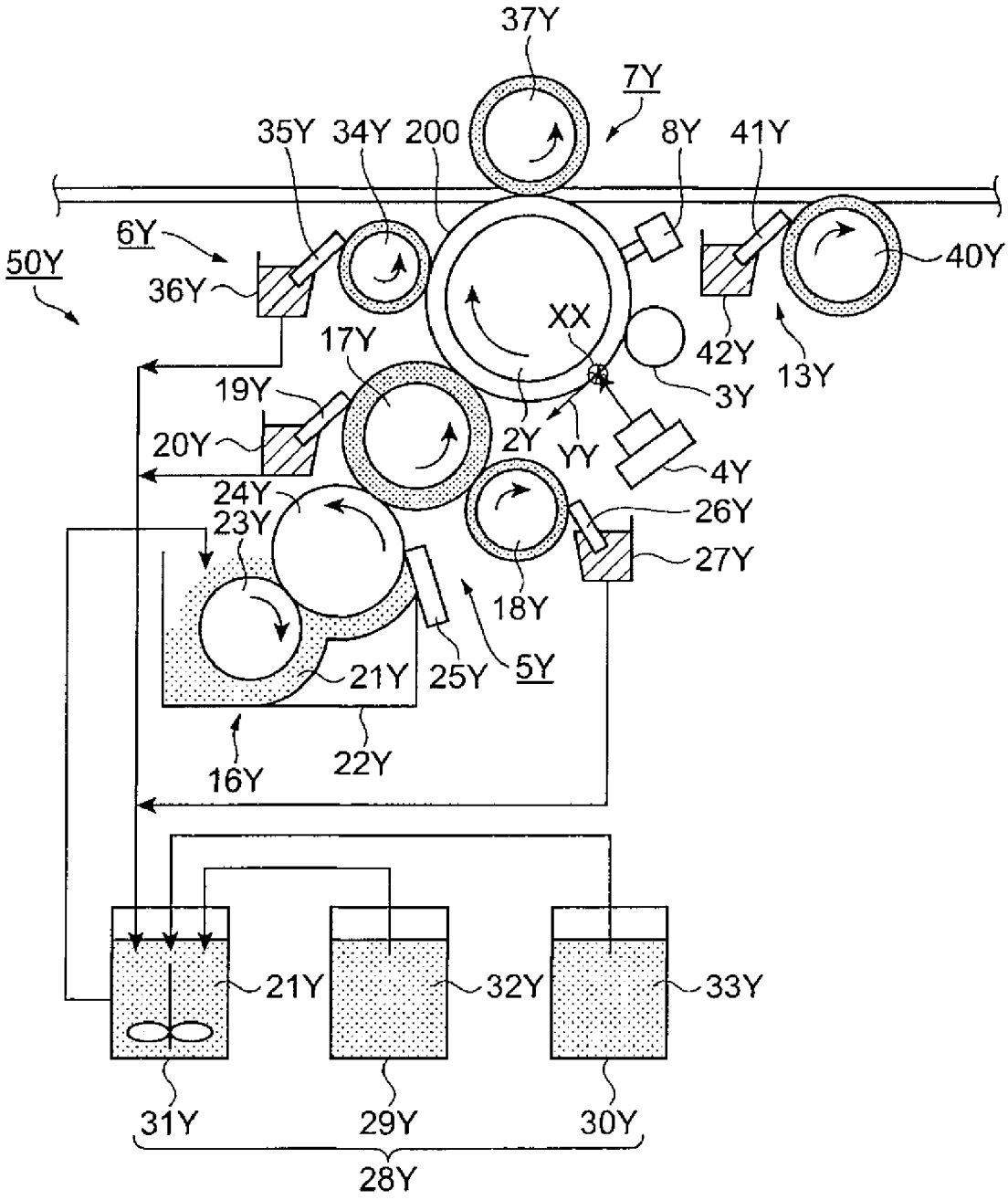
FIG. 2 is a schematic enlarged view of the primary transfer unit.

FIG. 2 is a schematic enlarged view of the primary transfer unit 50Y. Around the photosensitive member 2Y, a charging member 3Y, a line head 4Y as an exposing device, the developing device 5Y, a photosensitive member squeezer 6Y, the primary transfer device 7Y and a discharger 8Y are arranged in this order from an upstream side in the rotating direction.

The charging member 3Y is, for example, a charging roller. A bias having the same polarity as the charging polarity of the liquid developer is applied to the charging member 3Y from an unillustrated power supply. The charging member 3Y charges the photosensitive member 2Y. The line head 4Y forms an electrostatic latent image on the charged photosensitive member 2Y by exposing a surface 200 of the photosensitive member 2Y with light from a scanning optical system or the like using, for example, organic EL devices or LEDs. The line head 4Y is spaced apart from the photosensitive member 2Y. An incident direction of the light is shown by a solid-line arrow drawn from the line head 4Y. Scanning directions of the scanning optical system are defined such that a direction normal to the plane of FIG. 2 is a main scanning direction XX and a direction normal to the main scanning direction XX and tangent to the surface 200 of the photosensitive member 2Y to be exposed with the light is a sub scanning direction YY.

Figure 3:
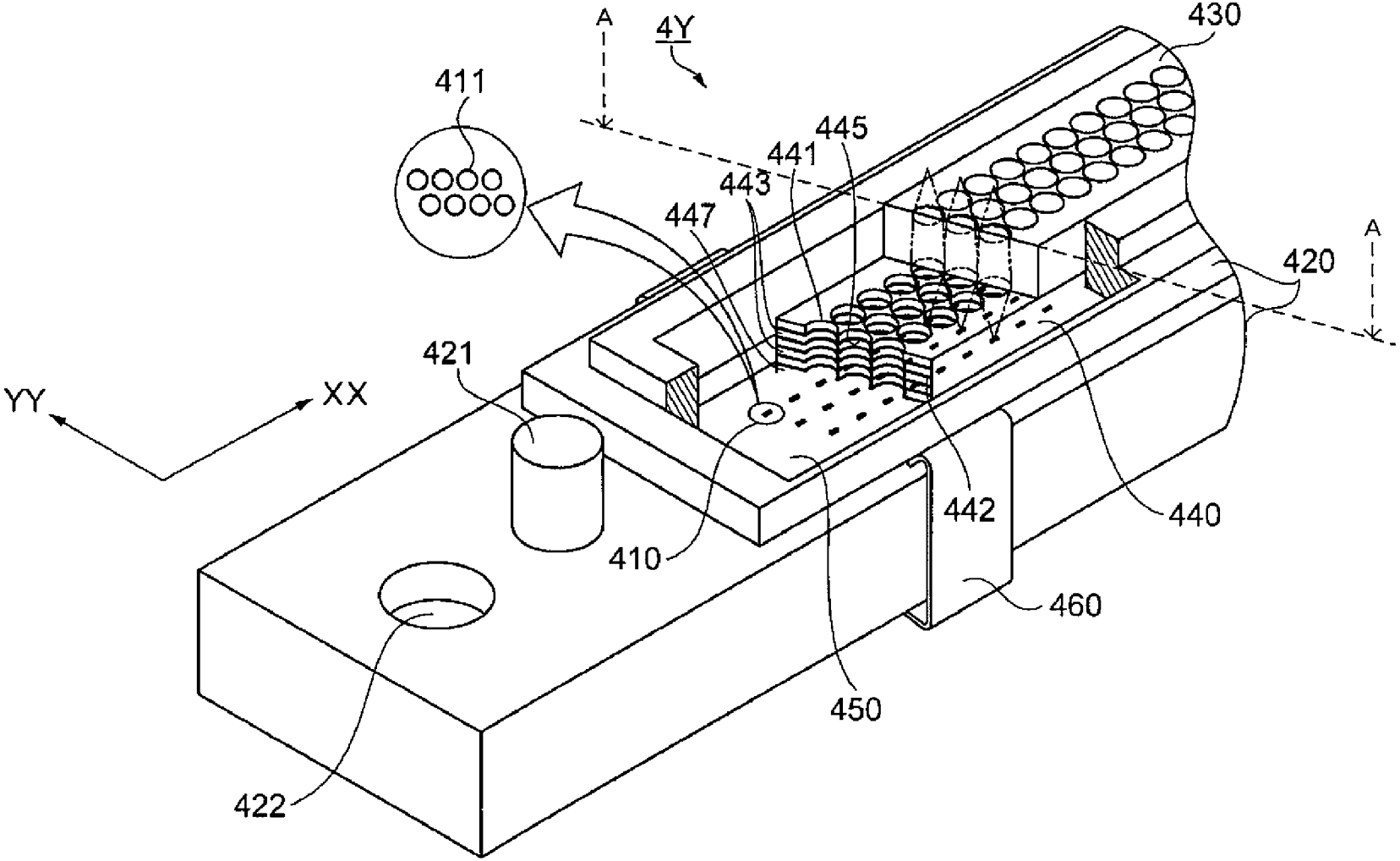
FIG. 3 is a perspective view schematically showing the line head according to this embodiment.
Figure 4:
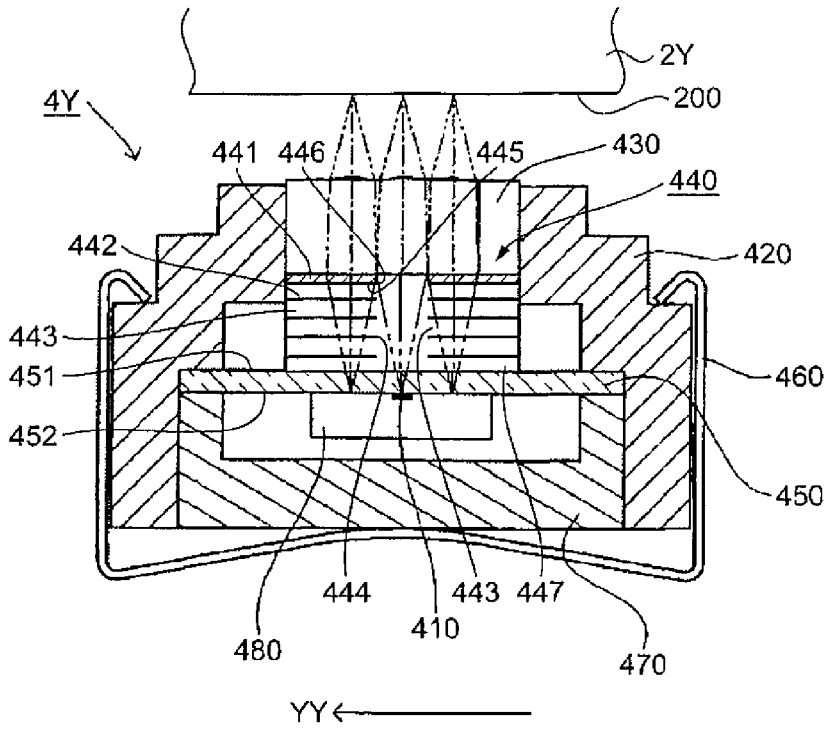
FIG. 4 is a sectional view of the line head in the sub scanning direction.

The line head 4Y according to this embodiment is described in detail below with reference to the drawings. FIG. 3 is a perspective view schematically showing the line head 4Y according to this embodiment, and FIG. 4 is a sectional view of the line head 4Y in the sub scanning direction YY. In FIG. 3, the line head 4Y includes light emitting element groups 410 aligned in the main scanning direction XX. Each light emitting element group 410 is comprised of a plurality of light emitting elements 411. Lights are emitted from these light emitting elements 411 to the surface 200 as a surface-to-be-scanned of the photosensitive member 2Y charged by the charging member 3Y as shown in FIG. 2, whereby an electrostatic latent image is formed on the surface 200.

In FIG. 3, the line head 4Y includes a case 420 whose longitudinal direction is the main scanning direction XX, and a positioning pin 421 and a screw insertion hole 422 are provided at each of the opposite ends of such a case 420. The line head 4Y is positioned relative to the photosensitive member 2Y by fitting such positioning pins 421 into positioning holes (not shown) perforated in an unillustrated photosensitive member cover. The photosensitive member cover covers the photosensitive member 2Y shown in FIG. 2 and is positioned relative to the photosensitive member 2Y. Further, the line head 4Y is positioned and fixed relative to the photosensitive member 2Y by screwing fixing screws into screw holes (not shown) of the photosensitive member cover via the screw insertion holes 422.

In FIGS. 3 and 4, the case 420 carries a microlens array 430, in which imaging lenses are arrayed, at a position facing the surface 200 of the photosensitive member 2Y, and is internally provided with a light shielding member 440 as a light shielding portion and a glass substrate 450 as a substrate, the light shielding member 440 being closer to the microlens array 430 than the glass substrate 450. The glass substrate 450 is a clear substrate. A plurality of light emitting element groups 410 are provided on an under surface 452 of the glass substrate 450 (surface opposite to a top surface 451 facing the light shielding member 440 out of two surfaces of the glass substrate 450). The plurality of light emitting element groups 410 are two-dimensionally and discretely arranged on the under surface 452 of the glass substrate 450 while being spaced by specified distances in the main scanning direction XX and the sub scanning direction YY as shown in FIG. 3. Here, each light emitting element group 410 is formed by two-dimensionally arraying a plurality of light emitting elements 411 as shown in an encircled part in FIG. 3.

In this embodiment, organic EL devices are used as the light emitting elements. In other words, the organic EL devices are arranged as light emitting elements 411 on the under surface 452 of the glass substrate 450 in this embodiment. Lights emitted from the respective plurality of light emitting elements 411 in directions toward the photosensitive member 2Y propagate toward the light shielding member 440 via the glass substrate 450. The light emitting elements may be LEDs. In this case, the substrate may not be a glass substrate and the LEDs can be provided on the top surface 451.

In FIGS. 3 and 4, the light shielding member 440 is formed by placing light shielding plates 445 and 442 one over the other with space layers 443 therebetween. A light shielding plate 441 is bonded to the light shielding plate 445. Here, the space layers 443 have substantially the same thickness. The light shielding plates 441 and 442 are formed with a plurality of light guide holes 444 in a one-to-one correspondence with the plurality of light emitting element groups 410. The light shielding plate 445 is formed with an aperture hole 446. A space layer 447 is defined between the glass substrate 450 and the light shielding plate 441 facing the glass substrate 450. The space layer 443 and the space layer 447 have substantially the same thickness. Here, the space layer 447 is a recess (447) when the light shielding member 440 is taken out alone. The light shielding plates 441, 442 and 445 are placed one over another via the space layers 443 such that the light guide holes 444 formed in the light shielding plates 441, 442 and the aperture hole 446 formed in the light shielding plate 445 communicate. In this embodiment, the light shielding plates are placed one over another such that these holes communicate with central axes thereof aligned with lines (shown by dashed-dotted line in FIG. 4) parallel to normals to the glass substrate 450.

In FIGS. 3 and 4, lights emitted from the light emitting elements 410 belonging to the light emitting element group 410 are introduced to the microlens array 430 through the light guide holes 444 and the aperture hole 446 in a one-to-one correspondence with the light emitting element group 410. The lights having passed through the light guide holes 444 formed in the light shielding member 440 are imaged as spots on the surface 200 of the photosensitive member 2Y by the microlens array 430 as shown by chain double-dashed line.

As shown in FIG. 4, an underside lid 470 is pressed against the case 420 via the glass substrate 450 by retainers 460. Specifically, the retainers 460 have elastic forces to press the underside lid 470 toward the case 420, and seal the inside of the case 420 light-tight (that is, so that light does not leak from the inside of the case 420 and so that light does not intrude into the case 420 from the outside) by pressing the underside lid 470 by means of the elastic forces. It should be noted that a plurality of the retainers 460 are provided at a plurality of positions in the longitudinal direction of the case 420 shown in FIG. 3. The light emitting element groups 410 are covered with a sealing member 480.

In this embodiment, the thickness of the light shielding plate 441 is, for example, about 0.40 mm, and that of the light shielding plates 442, 445 is 0.03 mm. The light guide holes 444 and the aperture holes 446 can be formed in the light shielding plates 441, 442 by etching and press working. The diameters of these holes differ, but are about 1 mm, and distances between the holes are 0.10 mm to 0.16 mm. As well known, a plurality of holes can be perforated by press working if the plate is made of metal and the distance between the holes is about 1.5 times as large as the plate thickness. In this embodiment, it is determined that the diameters of all the light guide holes 444 are 1.00 mm and those of the aperture holes 446 are 0.80 mm. Besides metals such as phosphor bronze, synthetic resins, ceramics and the like can be used as a material for the light shielding plates 441, 442 and 445. In the case of a synthetic resin or a ceramic, the plates can be formed by molding.

Figure 5:
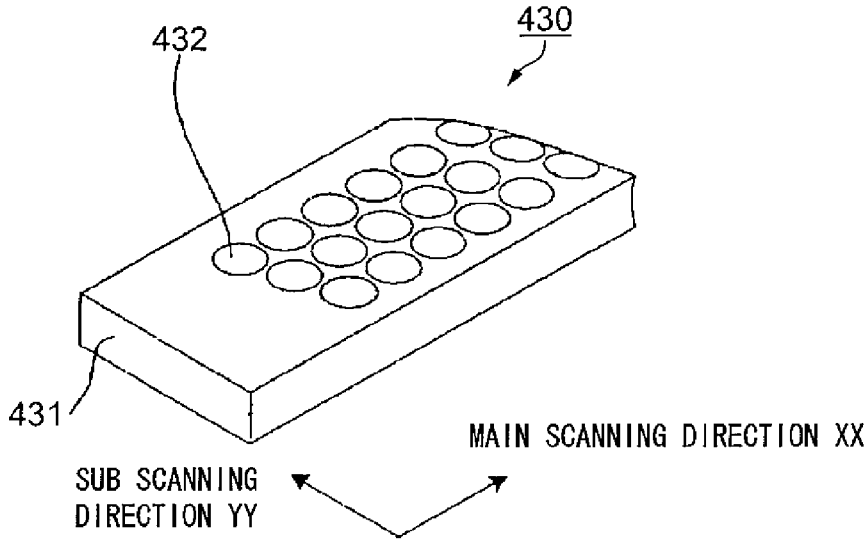
FIG. 5 is a perspective view schematically showing the microlens array.
Figure 6:
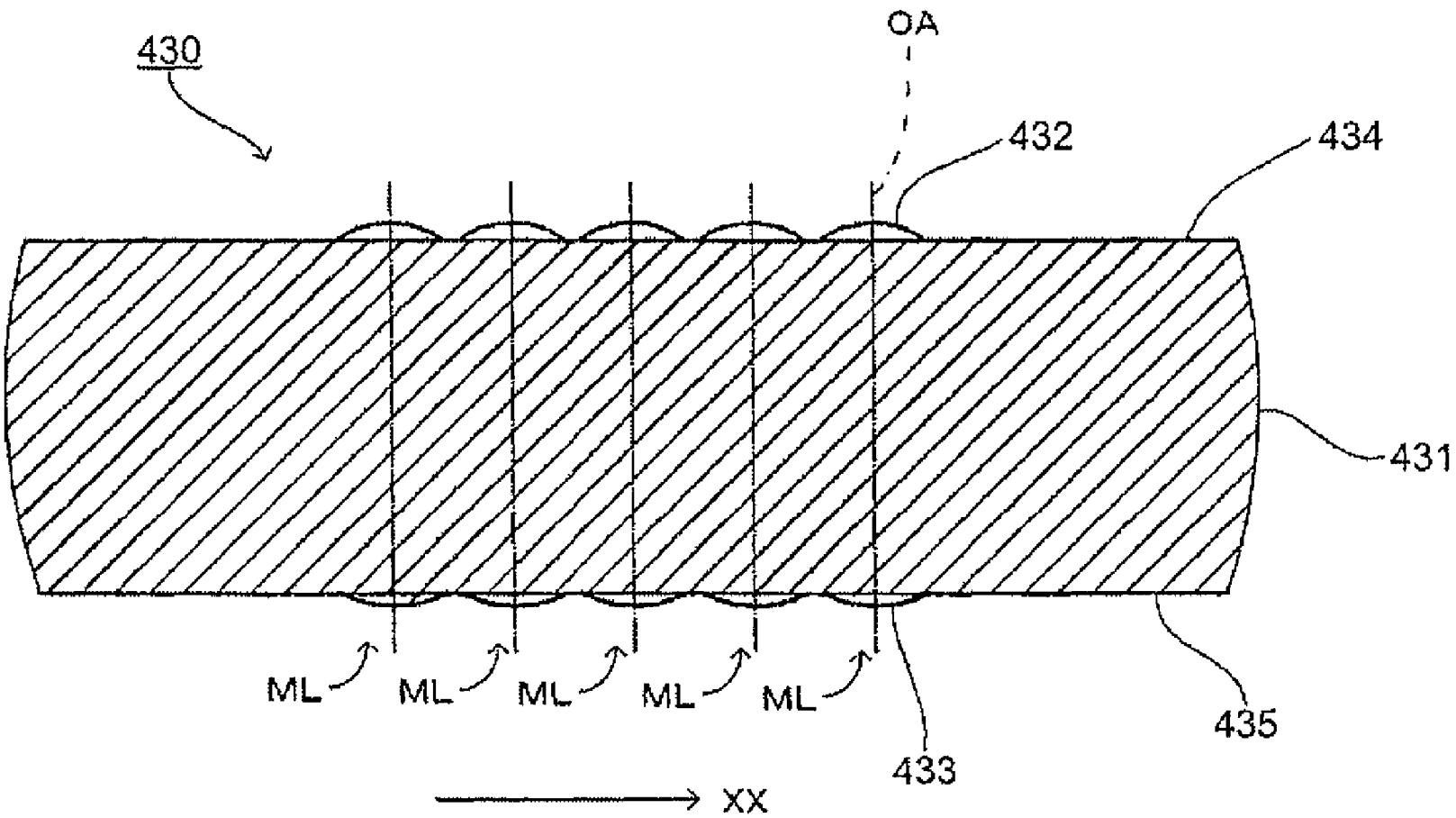
FIG. 6 is a sectional view of the microlens array in the main scanning direction.

FIG. 5 is a perspective view schematically showing the microlens array 430, and FIG. 6 is a sectional view of the microlens array 430 in the main scanning direction XX. The microlens array 430 includes a glass substrate 431 and a plurality of lens pairs, each comprised of two lenses 432, 433 and arranged in a one-to-one correspondence at the opposite sides of the glass substrate 431. These lenses 432, 433 can be made of a resin.

In FIG. 6, a plurality of lenses 432 are arranged on a top surface 434 of the glass substrate 431 and a plurality of lenses 433 are so arranged on an under surface 435 of the glass substrate 431 as to have a one-to-one correspondence with the plurality of lenses 432. The two lenses 432, 433 constituting the lens pair share an optical axis OA shown by dashed-dotted line in FIG. 6. These plurality of lens pairs are arranged in a one-to-one correspondence with the plurality of light emitting element groups 410 shown in FIG. 3. In this specification, an optical system made up of a one-to-one pair of lenses 432 and 433 and the glass substrate 431 located between such lens pair is called a "microlens ML". The microlenses ML as imaging lenses are two-dimensionally arranged in conformity with the arrangement of the light emitting element groups 410 while being spaced apart by specified distances in the main scanning direction XX and the sub scanning direction YY.

Figure 7:
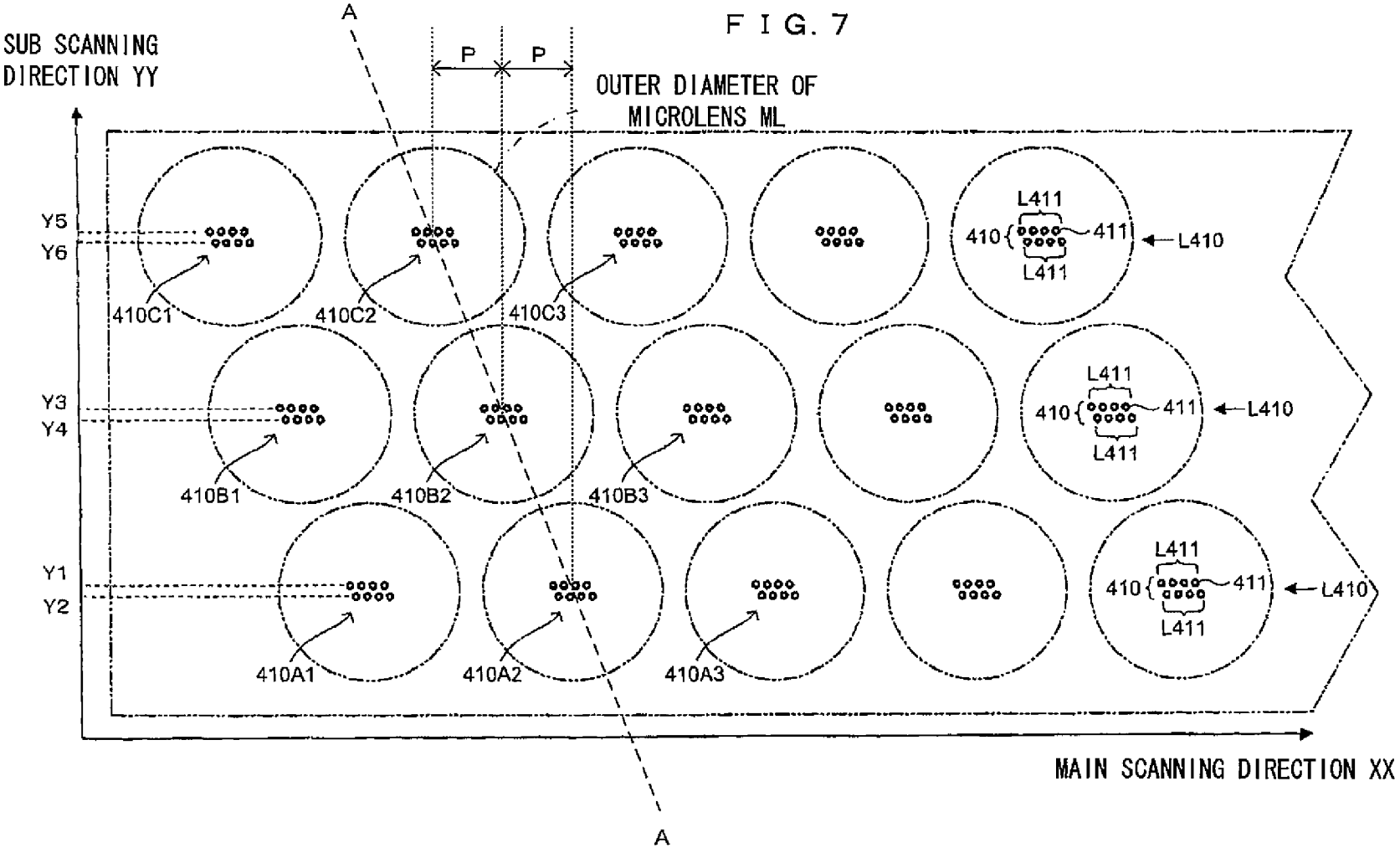
FIG. 7 is a diagram showing the arrangement of the plurality of light emitting elements.

FIG. 7 is a diagram showing the arrangement of the plurality of light emitting elements 410. In this embodiment, two light emitting element rows, in each of which four light emitting elements 411 are aligned at specified intervals in the main scanning direction XX, are arranged in the sub scanning direction YY to form one light emitting element group 410. In other words, eight light emitting elements 411 constitute the light emitting element group 410 corresponding to a position of the outer diameter of one microlens ML shown by a chain double-dashed line circle in FIG. 7. A plurality of light emitting element groups 410 are arranged as follows.

The light emitting element groups 410 are two-dimensionally arranged such that three light emitting element group rows L410 (group rows), in each of which a specified number (two or larger) of light emitting element groups 410 are aligned in the main scanning direction XX, are arranged in the sub scanning direction YY. All the light emitting element groups 410 are arranged at mutually different main scanning direction positions. Further, the plurality of light emitting element groups 410 are arranged such that the light emitting element groups (e.g. light emitting element groups 410C1, 410B1) adjacent in the main scanning direction mutually differ in their sub scanning direction positions. The main scanning direction position and the sub scanning direction position mean a main scanning direction component and a sub scanning direction component of a target position, respectively. In this specification, the "geometric center of gravity of the light emitting element group" means the geometric center of gravity of the positions of all the light emitting elements 411 belonging to the same light emitting element group 410. Hereinafter, the position of the geometric center of gravity is called a geometric center of gravity position E0.

Figure 8:
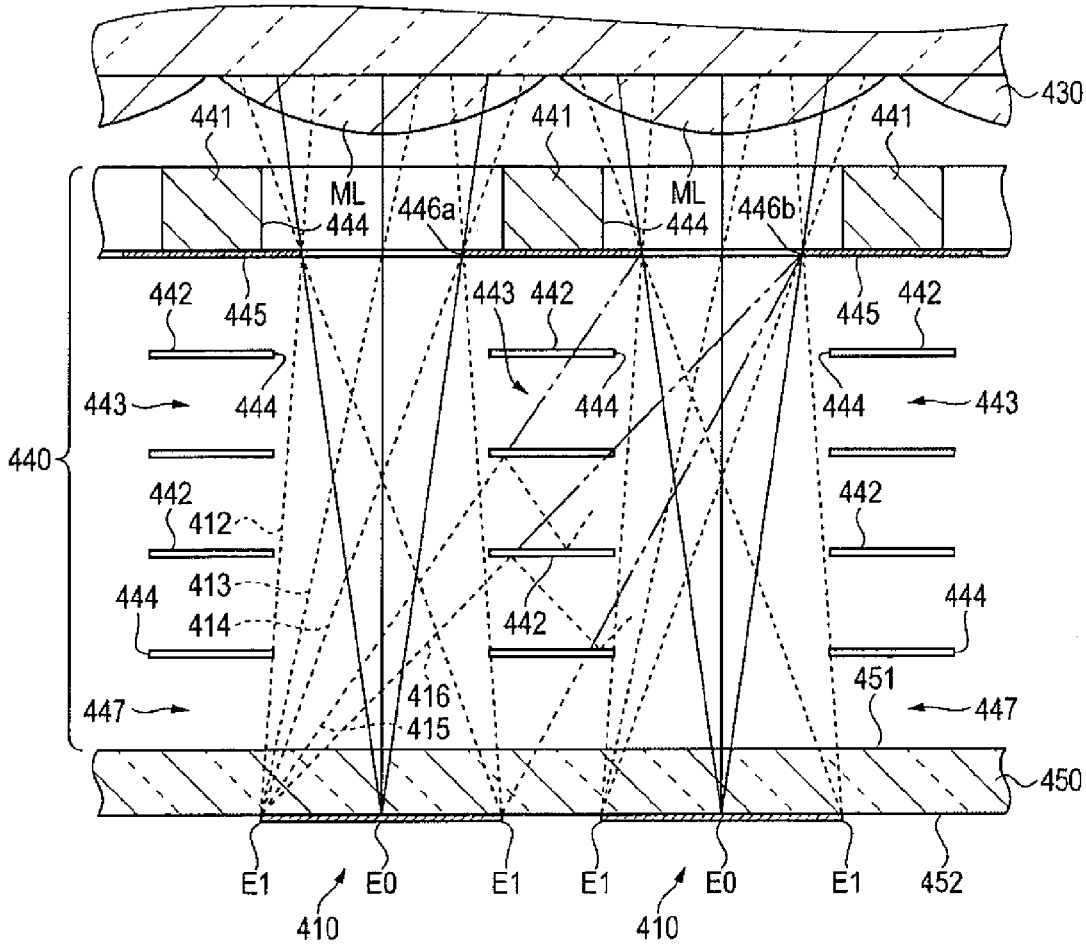
FIG. 8 is a partial enlarged sectional view showing the vicinity of the glass substrate, the light shielding member and the microlens array.

FIG. 8 is a partial enlarged sectional view showing the vicinity of the glass substrate 450, the light shielding member 440 and the microlens array 430. In this partial enlarged section, propagating states of the lights emitted from the light emitting element groups 410 are also shown.

In FIG. 8, in conformity with the arrangement of the light emitting element groups 410 shown in FIG. 7, the light guide holes 444 and aperture holes 446*a*, 446*b* are formed in the light shielding member 440 and the microlenses ML are arranged. Specifically, in this embodiment, the geometric centers of gravity position E0 of the light emitting element groups 410, the central axes of the light guide holes 444 and the aperture holes 446*a*, and the optical axes OA of the microlenses ML shown in FIG. 6 substantially coincide. The lights emitted from the light emitting element groups 410 are incident on the microlens array 430 through the corresponding light guide holes 444 and aperture holes 446*b*, and imaged as spots on the surface 200 of the photosensitive member 2Y shown in FIG. 4 by the microlenses ML.

In FIG. 8, the plurality of light emitting element groups 410 are discretely arranged on the under surface 452 of the glass substrate 450. The light shielding member 440 is arranged such that one surface thereof faces the top surface 451 of the glass substrate 450 and the other surface thereof faces the microlens array 430.

Out of the lights emitted from the light emitting element groups 410, optical paths of the lights emitted from the geometric center of gravity positions E0 of the light emitting element groups 410 are shown by solid lines and those of the lights emitted from positions E1 most distant from the geometric center of gravity positions E0 are shown by broken lines. Chain double-dashed lines show the shielded lights. As such optical paths show, the lights emitted from the respective positions emerge from the top surface 451 of the glass substrate 450 after being incident on the under surface 452 of the glass substrate 450. The lights emergent from the top surface 451 of the glass substrate 450 reach the surface 200 of the photosensitive member 2Y as the surface-to-be-scanned shown in FIGS. 2 and 4 after passing the light guide holes 444 and the aperture holes 446*a*, 446*b* and the microlens array 430.

The optical paths are described in detail below. For example, out of the lights emitted from the position E1, lights 412, 413 and 414 propagating toward the aperture hole 446*a* reach the microlens ML through the aperture hole 446*a*. Here, the light guide holes 444 are formed to have such a diameter as not to hinder the lights propagating toward the aperture hole 446*a*. The aperture holes 446*a*, 446*b* determine the lights to be incident on the microlenses ML. Accordingly, light amounts, focal depths and the like can be adjusted by the aperture holes 446*a*, 446*b*. Further, the light shielding plate 441 has a large thickness so as to prevent the leakage of lights to the neighboring microlenses ML.

Next, the lights propagating toward the space layers 443 are described with respect to those emitted from the position E1. For example, lights 415, 416 propagate toward the space layer 443 and are reflected by a surface of the light shielding plate 442 facing the glass substrate 450. The light amounts of the lights 415, 416 are attenuated by the reflection. The reflected lights 415, 416 are also reflected by a surface of another light shielding plate 442 facing the microlens array 430. Accordingly, the light amounts of the lights reflected by the surfaces of the light shielding plates 442 a plurality of times are more attenuated. Since the space layers 443 are thick as compared to the areas of the inner surfaces of the light guide holes 444, only small amounts of the lights are reflected by the inner surfaces of the light guide holes 444. Here, the thickness of the space layers 443 is larger than, preferably five times or more than that of the light shielding plate 441 to reduce the light amounts of the lights to be reflected by the inner surfaces of the light guide holes 444. The upper limit of the thickness of the space layers 443 is determined by a distance from the light emitting element groups 410 to the microlens array 430 specified by the optical system, that is, the thickness of the light shielding member 440 and the thickness and number of the light shielding plates 442 and, preferably thirty times or less of the distance. In order to more effectively attenuate the intensities of the lights 415, 416 by the reflection, antireflection layers, for instance, well-known black plating and the like may be applied to the surfaces of the light shielding plates 442.

The optical system of this embodiment is a so-called reduction optical system for imaging the light emitting element groups 410 in a reduced manner on the surface 200 of the photosensitive member 2Y shown in FIGS. 2 and 4. Further, the lights emitted from the geometric center of gravity positions E0 of the light emitting element groups 410 are imaged at imaging positions, which are intersections of the surface 200 of the photosensitive member 2Y and the optical axes OA of the microlenses ML shown in FIG. 6. This results from the fact that the geometric center of gravity positions E0 of the light emitting element groups 410 are located on the optical axes OA of the microlenses ML in this embodiment as described above. The lights emitted from the positions E1 are imaged at positions at opposite sides with respect to the optical axes OA of the microlenses ML in the main scanning direction XX shown in FIG. 6. In other words, the microlenses ML are so-called inverting optical systems having an inverting property. Since the optical system is the reduction optical system, distances between the imaged position of the light emitted from the geometric center of gravity position E0 and those of the lights emitted from the positions E1 on the surface 200 of the photosensitive member 2Y are shorter than distances between the geometric center of gravity position E0 and the positions E1 of the light emitting element group 410. In this embodiment, the microlenses ML function as "imaging lenses" in the invention.

Figure 9:
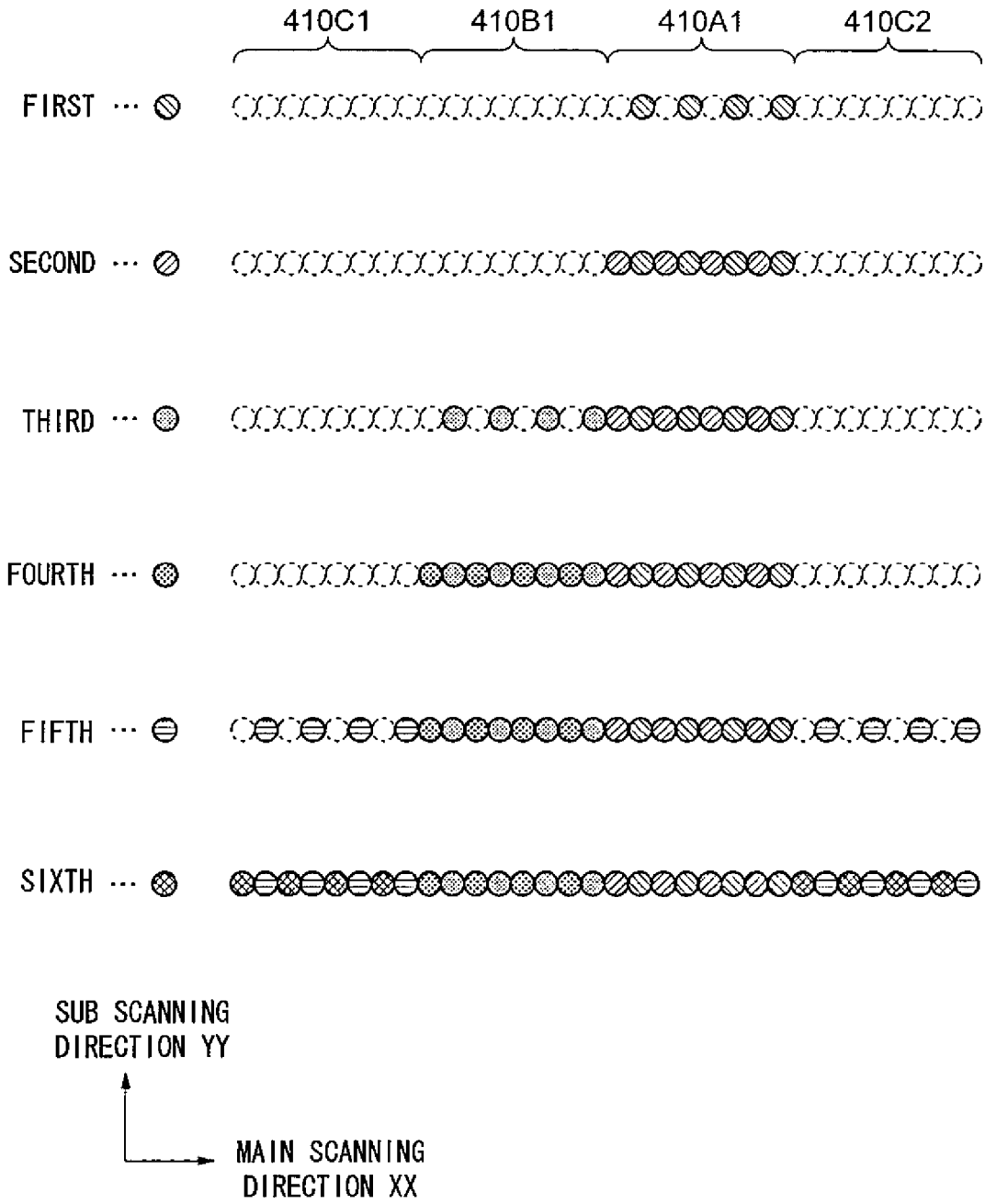
FIG. 9 is a diagram showing a spot forming operation by the line head.

FIG. 9 is a diagram showing a spot forming operation by the line head 4Y. An electrostatic latent image is formed by a collection of spots. The spot forming operation by the line head according to this embodiment is described with reference to FIGS. 7 and 9. In order to facilitate the understanding of the invention, here is described the case where a plurality of spots are aligned on a straight line extending in the main scanning direction XX. In this embodiment, the plurality of spots are formed side by side on the straight line extending in the main scanning direction XX by driving a plurality of light emitting elements to emit lights at specified timings while the surface 200 of the photosensitive member 2Y is conveyed in the sub scanning direction YY.

In FIG. 7, six light emitting element rows L411 are arranged in the sub scanning direction YY corresponding to sub scanning direction positions Y1 to Y6 in the line head 4Y of this embodiment. The light emitting element rows L411 located at the same sub scanning direction position are driven to emit lights substantially at the same timing, and those located at positions different in the sub scanning direction YY are driven to emit lights at mutually different timings. More specifically, the light emitting element rows L411 are driven to emit lights in an order of the sub scanning direction positions Y1 to Y6. By driving the light emitting element rows L411 to emit lights in the above order while the surface 200 of the photosensitive member 2Y is conveyed in the sub scanning direction YY, the plurality of spots are formed side by side on the straight line extending in the main scanning direction XX of the surface 200.

Such an operation is described with reference to FIGS. 7 and 9. First of all, the light emitting elements 411 of the light emitting element rows L411 at the sub scanning direction position Y1 belonging to the most upstream light emitting element groups 410A1, 410A2, 410A3, . . . in the sub scanning direction YY are driven to emit lights. A plurality of lights emitted by such a light emitting operation are imaged on the surface 200 of the photosensitive member 2Y by the microlenses ML, which are "imaging lenses" having the aforementioned inverting and reducing property, while being inverted and reduced. In other words, spots are formed at hatched positions of the "first operation" of FIG. 9. In FIG. 9, white circles represent spots that are not formed yet, but planned to be formed later. In FIG. 9, spots labeled by reference numerals 410C1, 410B1, 410A1 and 410C2 are those to be formed by the light emitting element groups 410 corresponding to the respective attached reference numerals.

Subsequently, the light emitting elements 411 of the light emitting element rows L411 at the sub scanning direction position Y2 belonging to the same light emitting element groups 410A1, 410A2, 410A3, . . . are driven to emit lights. A plurality of lights emitted by such a light emitting operation are imaged on the surface 200 of the photosensitive member 2Y by the microlenses ML while being inverted and reduced. In other words, spots are formed at hatched positions of the "second operation" of FIG. 9. Here, whereas the surface 200 of the photosensitive member 2Y is conveyed in the sub scanning direction YY, the light emitting element rows L411 are successively driven to emit lights from the downstream ones in the sub scanning direction YY (i.e. in the order of the sub scanning direction positions Y1, Y2). This is to deal with the inverting property of the microlenses LS.

Subsequently, the light emitting elements 411 of the light emitting element rows L411 at the sub scanning direction position Y3 belonging to the second most upstream light emitting element groups 410B1, 410B2, 410B3, . . . in the sub scanning direction YY are driven to emit lights. A plurality of lights emitted by such a light emitting operation are imaged on the surface 200 of the photosensitive member 2Y by the microlenses ML while being inverted and reduced. In other words, spots are formed at hatched positions of the "third operation" of FIG. 9.

Subsequently, the light emitting elements 411 of the light emitting element rows L411 at the sub scanning direction position Y4 belonging to the same light emitting element groups 410B1, 410B2, 410B3, . . . are driven to emit lights. A plurality of lights emitted by such a light emitting operation are imaged on the surface 200 of the photosensitive member 2Y by the microlenses LS while being inverted and reduced. In other words, spots are formed at hatched positions of the "fourth operation" of FIG. 9.

Subsequently, the light emitting elements 411 of the light emitting element rows L411 at the sub scanning direction position Y5 belonging to the most downstream light emitting element groups 410C1, 410C2, 410C3, . . . in the sub scanning direction YY are driven to emit lights. A plurality of lights emitted by such a light emitting operation are imaged on the surface 200 of the photosensitive member 2Y by the microlenses ML while being inverted and reduced. In other words, spots are formed at hatched positions of the "fifth operation" of FIG. 9.

Finally, the light emitting elements 411 of the light emitting element rows L411 at the sub scanning direction position Y6 belonging to the same light emitting element groups 410C1, 410C2, 410C3, . . . are driven to emit lights. A plurality of lights emitted by such a light emitting operation are imaged on the surface 200 of the photosensitive member 2Y by the microlenses ML while being inverted and reduced. In other words, spots are formed at hatched positions of the "sixth operation" of FIG. 9. By performing the first to sixth light emitting operations in this way, a plurality of spots are formed while being aligned on the straight line extending in the main scanning direction XX.

Next, referring back to FIG. 2, the developing device 5Y is described. The developing device 5Y develops an electrostatic latent image formed on the photosensitive member 2Y with a liquid developer 21Y. In FIG. 2, the developing device 5Y includes a developer supplier 16Y, a developing roller 17Y, a compaction roller 18Y, a developing roller cleaner 19Y and a developing roller cleaner collection liquid storage section 20Y.

The developer supplier 16Y includes a developer container 22Y for storing the liquid developer 21Y comprised of toner particles and a nonvolatile liquid carrier, a developer scoop-up roller 23Y, an anilox roller 24Y and a developer restricting blade 25Y.

In the liquid developer 21Y stored in the developer container 22Y, particles having, for example, an average particle diameter of 1 μm and obtained by dispersing a known colorant such as pigment in a likewise known thermoplastic resin used for toner can be used as toner particles. In order to obtain a liquid developer having a low viscosity and a low density, insulating liquid carrier including, for instance, an organic solvent, a silicone oil having an ignition point of 210 degrees centigrade or higher such as phenyl methyl siloxane, dimethyl polysiloxane and polydimethyl cyclosiloxane, and a mineral oil can be used as the liquid carrier. The liquid developer 21Y is obtained by adding the toner particles into the liquid carrier together with a dispersant in such a manner as to have a toner solid concentration of about 20%.

The developer scoop-up roller 23Y is a roller for scooping up the liquid developer 21Y in the developer container 22Y and supplying it to the anilox roller 24Y. The developer scoop-up roller 23Y is rotated clockwise as shown by an arrow in FIG. 2. The anilox roller 24Y is a cylindrical member having fine spiral grooves uniformly formed on the outer surface thereof. The grooves are, for example, dimensioned such that the groove pitch is about 130 μm and the groove depth is about 30 μm. Of course, the dimensions of the grooves are not limited to these values. The anilox roller 24Y is rotated counterclockwise as shown by an arrow in FIG. 2 in the same direction as the developing roller 17Y. The anilox roller 24Y may be rotated clockwise, following the rotation of the developing roller 17Y. In other words, the rotating direction of the anilox roller 24Y can be arbitrarily set without being limited.

The developer restricting blade 25Y is disposed in contact with the outer surface of the anilox roller 24Y. The developer restricting blade 25Y is comprised of a rubber portion made of a urethane rubber or the like and held in contact with the outer surface of the anilox roller 24Y and a plate made of a metal or the like for supporting the rubber portion. The developer restricting blade 25Y removes the liquid developer 21Y adhering to the outer surface of the anilox roller 24Y excluding the grooves by scraping it off with the rubber portion. Accordingly, the anilox roller 24Y supplies only the liquid developer 21Y adhering in the grooves to the developing roller 17Y.

The developing roller 17Y is comprised of a metallic shaft made of an iron for instance, and a cylindrical electrically conductive elastic member having a specified width and including an electrically conductive resin or rubber layer made of an electrically conductive urethane rubber and the like which is mounted on the outer circumferential surface of the metallic shaft. The developing roller 17Y is held in contact with the photosensitive member 2Y and rotated counterclockwise as shown by an arrow in FIG. 2.

The compaction roller 18Y is so arranged as to hold the outer circumferential surface thereof in contact with the outer circumferential surface of the developing roller 17Y. At this time, the compaction roller 18Y and the developing roller 17Y bite each other by a specified amount.

The compaction roller 18Y is rotated clockwise as shown by an arrow in FIG. 2. The compaction roller 18Y has a voltage applied thereto to charge the developing roller 17Y. In this case, a direct-current voltage (DC) is set as the voltage applied to the compaction roller 18Y. A voltage obtained by superposing an alternating-current voltage (AC) on a direct-current voltage (DC) may be set as the voltage applied to the compaction roller 18Y.

By charging the developing roller 17 with the compaction roller 18Y, the compaction roller 18Y applies a contact compaction to the liquid developer 21Y on the developing roller 17Y.

By the contact compaction by the compaction roller 18Y, the liquid developer 21Y on the developing roller 17Y is pressed against the developing roller 17Y.

The compaction roller 18Y includes a compaction roller cleaner blade 26Y and a compaction roller cleaner collection liquid storage section 27Y. The compaction roller cleaner blade 26Y is made of, for example, rubber or the like held in contact with the outer surface of the compaction roller 18Y and removes the liquid developer 21Y residual on the compaction roller 18Y by scraping it off. The compaction roller cleaner collection liquid storage section 27Y includes a container such as a tank for storing the liquid developer 21Y scraped off from the compaction roller 18Y by the compaction roller cleaner blade 26Y.

The developing roller cleaner 19Y is made of, for example, rubber or the like held in contact with the outer surface of the developing roller 17Y and removes the liquid developer 21Y residual on the developing roller 17Y by scraping it off. The developing roller cleaner collection liquid storage section 20Y includes a container such as a tank for storing the liquid developer 21Y scraped off from the developing roller 17Y by the developing roller cleaner 19Y.

The image forming apparatus 1 further includes a developer replenishing device 28Y for replenishing the liquid developer 21Y into the developer container 22Y. The developer replenishing device 28Y includes a toner tank 29Y, a carrier tank 30Y and an agitator 31Y.

A high-concentration liquid toner 32Y is stored in the toner tank 29Y, and a liquid carrier (carrier oil) 33Y is stored in the carrier tank 30Y. A specified amount of the high-concentration liquid toner 32Y from the toner tank 29Y and a specified amount of the liquid carrier 33Y from the carrier tank 30Y are supplied to the agitator 31Y.

The agitator 31Y mixes and agitates the supplied high-concentration liquid toner 32Y and liquid carrier 33Y to produce the liquid developer 21Y to be used in the developing device 5Y. In this case, it is preferable that the viscosity of the entire liquid developer 21Y is 100 mPas to 1000 mPas and that the viscosity of the liquid carrier (carrier oil) alone is 10 mPas to 200 mPas. The viscosity is measured using, for example, a viscoelasticity measuring apparatus ARES (manufactured by T A Instruments, Japan). The liquid developer 21Y produced by the agitator 31Y is supplied to the developer container 22Y.

The photosensitive member squeezer 6Y includes a squeeze roller 34Y, a squeeze roller cleaner 35Y and a squeeze roller cleaner collection liquid storage container 36Y. The squeeze roller 34Y is disposed downstream of a contact portion (nip portion) of the photosensitive member 2Y and the developing roller 17Y in the rotating direction of the photosensitive member 2Y. The squeeze roller 34Y is rotated in a direction (counterclockwise in FIG. 2) opposite to the rotating direction of the photosensitive member 2Y to remove the liquid developer 21Y on the photosensitive member 2Y.

An elastic roller having an elastic member such as an electrically conductive urethane rubber and a fluororesin surface layer provided on the outer surface of a metallic core is suitably used as the squeeze roller 34Y. The squeeze roller cleaner 35Y is made of an elastic body such as rubber and held in contact with the surface of the squeeze roller 34Y to remove the liquid developer 21Y residual on the squeeze roller 34Y by scraping it off. The squeeze roller cleaner collection liquid storage container 36Y is a container such as a tank for storing the liquid developer 21Y scraped off by the squeeze roller cleaner 35Y.

A voltage of about −200 V having a polarity opposite to the charging polarity of the toner particles is applied to the backup roller 37Y to primarily transfer an image formed on the photosensitive member 2Y with the liquid developer 21Y to the intermediate transfer belt 10. Further, the discharger 8Y removes electric charges residual on the photosensitive member 2Y after the primary transfer.

The intermediate transfer belt squeezer 13Y includes an intermediate transfer belt squeeze roller 40Y, an intermediate transfer belt squeeze roller cleaner 41Y and an intermediate transfer belt squeeze roller cleaner collection liquid storage container 42Y. The intermediate transfer belt squeeze roller 40Y collects the liquid developer 21Y on the intermediate transfer belt 10. The intermediate transfer belt squeeze roller cleaner 41Y scrapes off the collected liquid developer 21Y on the intermediate transfer belt squeeze roller 40Y. The intermediate transfer belt squeeze roller cleaner 41Y is made of an elastic material such as rubber similar to the squeeze roller cleaner 35Y. The intermediate transfer belt squeeze roller cleaner collection liquid storage container 42Y collects and stores the liquid developer 21Y scrapped off by the intermediate transfer belt squeeze roller cleaner 41Y.

When an image forming operation is started, the photosensitive member 2Y is uniformly charged by the charging member 3Y. Subsequently, an electrostatic latent image is formed on the photosensitive member 2Y by the line head 4Y. Subsequently, in the developing device 5Y, the liquid developer 21Y of yellow (Y) is scooped up to the anilox roller 24Y by the developer scoop-up roller 23Y. A proper amount of the liquid developer 21Y adhering to the anilox roller 24Y is caused to adhere in the grooves of the anilox roller 24Y by the developer restricting blade 25Y. The liquid developer 21Y in the grooves of the anilox roller 24Y is supplied to the developing roller 17Y.

At this time, a part of the liquid developer 21Y in the grooves of the anilox roller 24Y moves toward the opposite left and right ends of the anilox roller 24Y. Further, the yellow (Y) toner particles of the liquid developer 21Y on the developing roller 17Y are pressed against the developing roller 17Y by the contact compaction by the compaction roller 18Y. The liquid developer 21Y on the developing roller 17Y is conveyed toward the photosensitive member 2Y by the rotation of the developing roller 17Y while being compacted.

After completing the contact compaction by the compaction roller 18Y, the liquid developer 21Y residual on the compaction roller 18Y is removed from the compaction roller 18Y by the compaction roller cleaner blade 26Y.

The electrostatic latent image formed on the photosensitive member 2Y of yellow (Y) is developed with the liquid developer 21Y of yellow (Y) in the developing device 5Y, whereby an image is formed on the photosensitive member 2Y with the liquid developer 21Y of yellow (Y). After completing the image development, the liquid developer 21Y residual on the developing roller 17Y is removed from the developing roller 17Y by the developing roller cleaner 19Y. The image formed with the liquid developer 21Y of yellow (Y) on the photosensitive member 2Y is formed into a yellow (Y) toner image by collecting the liquid developer 21Y on the photosensitive member 2Y by means of the squeeze roller 34Y. Further, this yellow (Y) toner image is transferred to the intermediate transfer belt 10 by the primary transfer device 7Y. The yellow (Y) toner image on the intermediate transfer belt 10 is conveyed toward the primary transfer device 7M of magenta (M) shown in FIG. 1 while the liquid developer 21Y on the intermediate transfer belt 10 is collected by the intermediate transfer belt squeeze roller 40Y.

In FIG. 1, an electrostatic latent image formed on the photosensitive member 2M of magenta (M) is subsequently developed with a magenta (M) liquid developer conveyed as in the case of yellow (Y) in the developing device 5M, whereby an image is formed with the magenta (M) liquid developer on the photosensitive member 2M. At this time, the carrier residual on a compaction roller 18M after the completion of the contact compaction by the compaction roller 18M is removed from the compaction roller 18M by a compaction roller cleaner blade 26M. Further, the liquid developer residual on the developing roller 17M after the completion of the image development is removed from the developing roller 17M by a developing roller cleaner 19M.

The image formed with the liquid developer 21M of magenta (M) on the photosensitive member 2M is formed into a magenta (M) toner image by the liquid developer on the photosensitive member 2M being collected by means of the squeeze roller 34M. This magenta (M) toner image is transferred to the intermediate transfer belt 10 in the primary transfer device 7M while being superimposed on the yellow (Y) toner image. Similarly, the superimposed yellow (Y) and magenta (M) toner images are conveyed toward the primary transfer device 7C of cyan (C) while the liquid developer on the intermediate transfer belt 10 is collected by the intermediate transfer belt squeeze roller 40M. Hereinafter, a cyan (C) toner image and a black toner image are successively similarly transferred in a superimposed manner to the intermediate transfer belt 10, whereby a full color toner image is formed on the intermediate transfer belt 10.

Subsequently, the color toner image on the intermediate transfer belt 10 is secondarily transferred to a transfer surface of a transfer material such as a sheet by the secondary transfer device 14. The color toner image transferred to the transfer material is fixed as before by an unillustrated fixing device, and the transfer material having the full color fixed image formed thereon is conveyed to a discharge tray, whereby the color image forming operation is completed.

Figure 10:
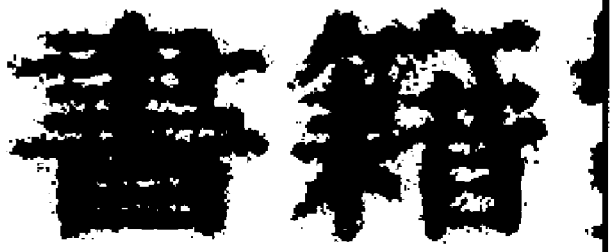
FIG. 10 is a chart comparing an image formed by the image forming apparatus according to this embodiment and an image formed using a conventional light shielding member.
Figure 10:
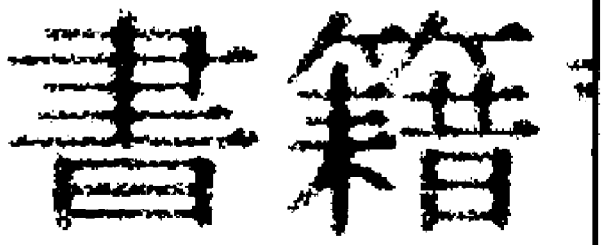

FIG. 10 is a chart comparing an image formed by the image forming apparatus 1 according to this embodiment and an image formed using a conventional light shielding member. The conventional light shielding member is such that one light guide hole is formed to penetrate the light shielding member and the inner surface of the light guide hole is not divided by space layers. In a comparative example, character outlines are unclear, particularly spaces between the lines of the characters are unclear. On the other hand, it could be confirmed that character outlines were clear and spaces between the lines of the characters were clear in this embodiment as compared to the comparative example.

The embodiment described above has the following effects. (1) The lights having entered the communicating light guide holes 444 of the light shielding member 440 are reflected only by the inner surfaces of the light guide holes 444 formed in the plurality of light shielding plates 442. On the other hand, the lights propagating toward the space layers 443 between the light shielding plates 442 are reflected toward the incidence side by the light shielding plates 442. Further, the lights propagating toward the space layers 443 are attenuated through a plurality of reflections. Therefore, there can be obtained the light shielding member 440 with a reduced production of stray lights by reflections.

(2) Since the thicknesses of the space layers 443 are five to thirty times as large as the heights of the inner surfaces of the light guide holes 444 formed in the light shielding plates 442 in a thickness direction, the amount of the lights reflected by the inner surfaces of the light guide holes 444 can be reduced as compared with the amount of the lights propagating toward the space layers 443, wherefore the light shielding member 440 with an even reduced production of stray lights can be obtained.

(3) Out of the lights incident from the side of the recess 447 (space layer 447), the amount of the lights propagating toward the recess 447 can be increased, whereby the reflection by the inner surfaces of the light guide holes 444 can be further suppressed.

(4) The lights emitted from the light emitting elements 411 enter the communicating light guide holes 444 of the light shielding member 440 and are reflected by the inner surfaces of the light guide holes 444 formed in the plurality of light shielding plates 442. On the other hand, the lights propagating toward the space layers 443 between the light shielding plates 442 are reflected toward the incidence side by the light shielding plates 442. Further, the lights propagating toward the space layers 443 between the light shielding plates 442 are attenuated through a plurality of reflections. Therefore, stray lights produced upon being reflected by the inner surfaces of the light guide holes 444 and passing the light shielding member 440 are reduced and there can be obtained the line heads 4Y, 4M, 4C and 4K with a reduced occurrence of ghost caused by the stray lights incident on the microlenses ML.

(5) Since the image forming apparatus 1 includes the line heads 4Y, 4M, 4C and 4K capable of attaining the above effects, spots with a reduced occurrence of ghost can be formed on the surface 200. Therefore, the spots become clear and the image forming apparatus with a smaller reduction in image quality can be obtained.

Second Embodiment

Figure 11:
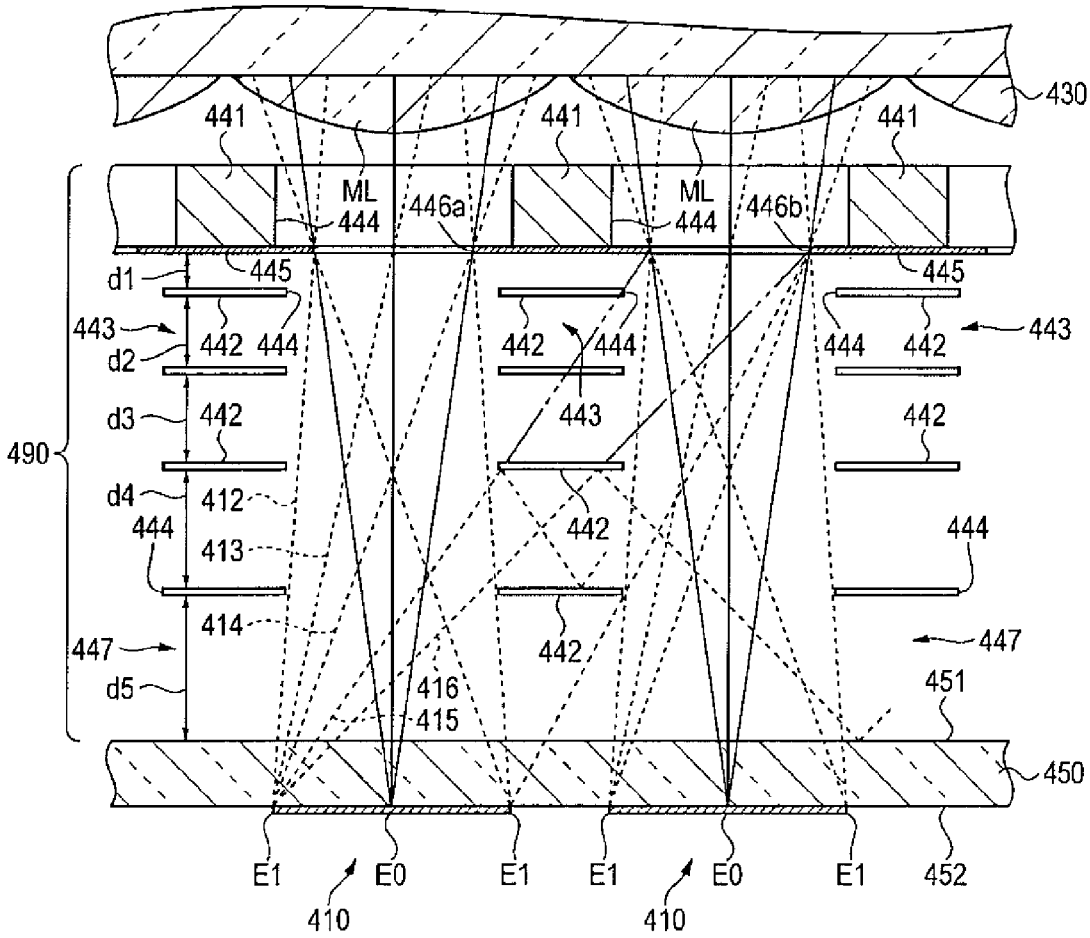
FIG. 11 is a partial enlarged sectional view showing the vicinity of a glass substrate, a light shielding member and a microlens array according to the second embodiment of the invention.

An image forming apparatus and a line head according to this embodiment differ from those of the first embodiment in the construction of the light shielding member, but the other constructions thereof are the same as in the first embodiment. FIG. 11 is a partial enlarged sectional view showing the vicinity of a glass substrate 450, a light shielding member 490 and a microlens array 430 according to the second embodiment of the invention. In FIG. 11, the light shielding member 490 of this embodiment is constructed such that thickness d1 of a space layer 443 between a light shielding plate 445 and a light shielding plate 442, thicknesses d2, d3, d4 of space layers 443 between the light shielding plates 442 and thickness d5 of a space layer 447 between the light shielding plate 442 and the glass substrate 450 differ. The light shielding plates 442, 445 are arranged such that the relationship of d1, d2, d3, d4 and d5 is d1<d2<d3<d4<d5. The other construction of the light shielding member 490 is the same as in the first embodiment.

This embodiment has the following effects in addition to the above-described effects of the previous embodiment. (6) The reflected light amount per unit area of the lights reflected by the inner surfaces of the light guide holes 444 near the incidence positions of the lights is larger than that of the lights reflected by the inner surfaces of the light guide holes 444 distant from the incidence positions of the lights. Since the depth of a recess 447 (space layer 447) is larger than the thicknesses of the space layers 443, a larger amount of lights can propagate toward the recess 447 out of the lights incident from the side of the recess 447 and it is possible to obtain the light shielding member 490 with a reduced production of stray lights, the line heads 4Y, 4M, 4C and 4K with a reduced occurrence of ghost caused by stray lights, and the image forming apparatus with a smaller reduction in image quality.

(7) The closer the space layers 443 are to the recess 447, the thicker the space layers 443 are. Thus, the amount of the lights propagating toward the space layers 443 can be increased out of the lights incident from the side of the recess 447 and it is possible to obtain the light shielding member 490 with a reduced production of stray lights, the line heads 4Y, 4M, 4C and 4K with a reduced occurrence of ghost caused by stray lights, and the image forming apparatus with a smaller reduction in image quality.

Third Embodiment

Figure 12:
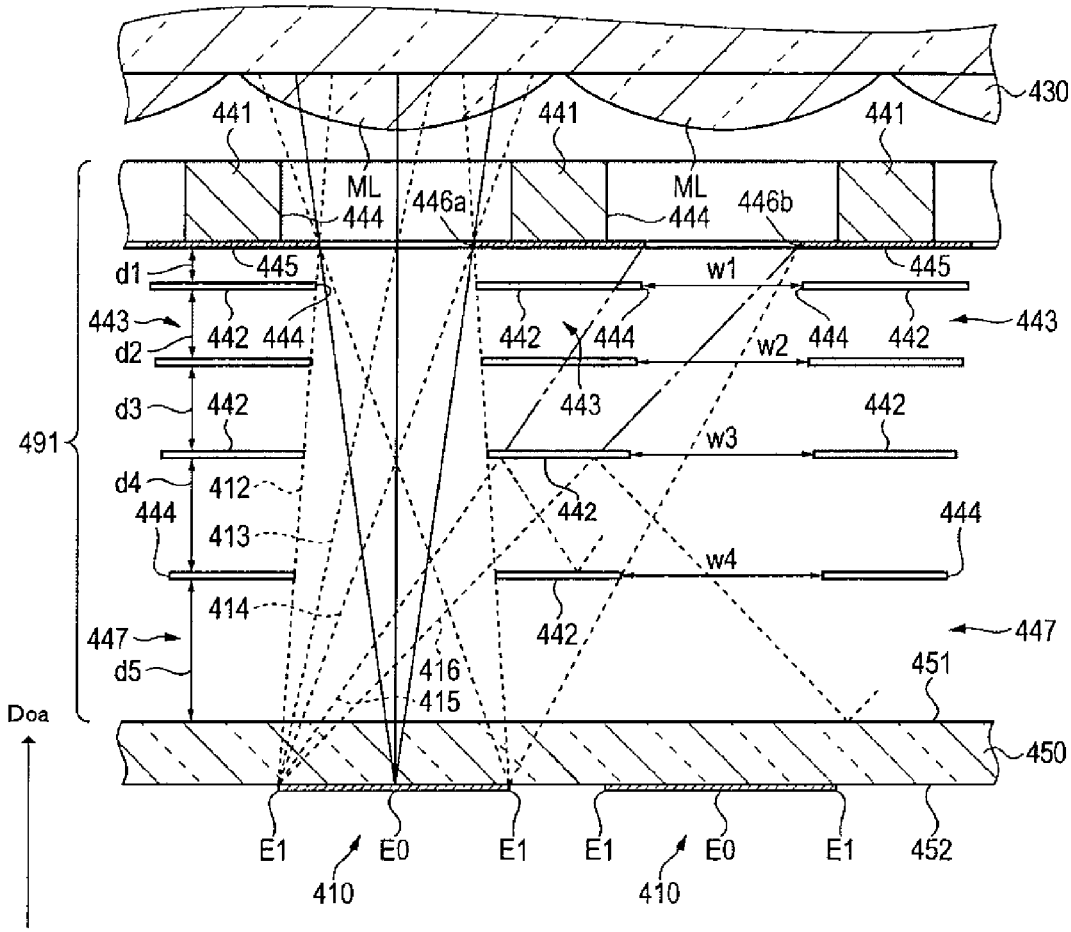
FIG. 12 is a partial enlarged sectional view showing the vicinity of a glass substrate, a light shielding member and a microlens array according to the third embodiment of the invention.

An image forming apparatus and a line head according to this embodiment differ from those of the second embodiment in the construction of the light shielding member, but the other constructions thereof are the same as in the second embodiment. FIG. 12 is a partial enlarged sectional view showing the vicinity of a glass substrate 450, a light shielding member 491 and a microlens array 430 according to the third embodiment of the invention. In FIG. 12, the light shielding member 491 of this embodiment is constructed such that the sizes of the light guide holes 44 differ depending on light shielding plates 442. Specifically, when w1 denotes the width of the light guide holes 444 of the light shielding plate 442 closest to the microlens array 430 and w2, w3, w4 denote the widths of the light guide holes 444 of the light shielding plates 442 in the order toward the glass substrate 450, the widths of the respective light guide holes are: w1<w2<w3<w4. A spacing d1 between a light shielding plate 445 and the light shielding plate 442, spacings d2, d3, d4 between the light shielding plates 442 and a spacing d5 between the light shielding plate 442 and the glass substrate 450 are the same as those in the second embodiment.

This embodiment has the following effects in addition to the above-described effects of the previous embodiments. (8) It is possible to introduce a larger amount of the lights incident from the side of a recess 447 and to more suppress the reflection of the lights incident from the side of the recess 447.

Fourth Embodiment

Figure 13:
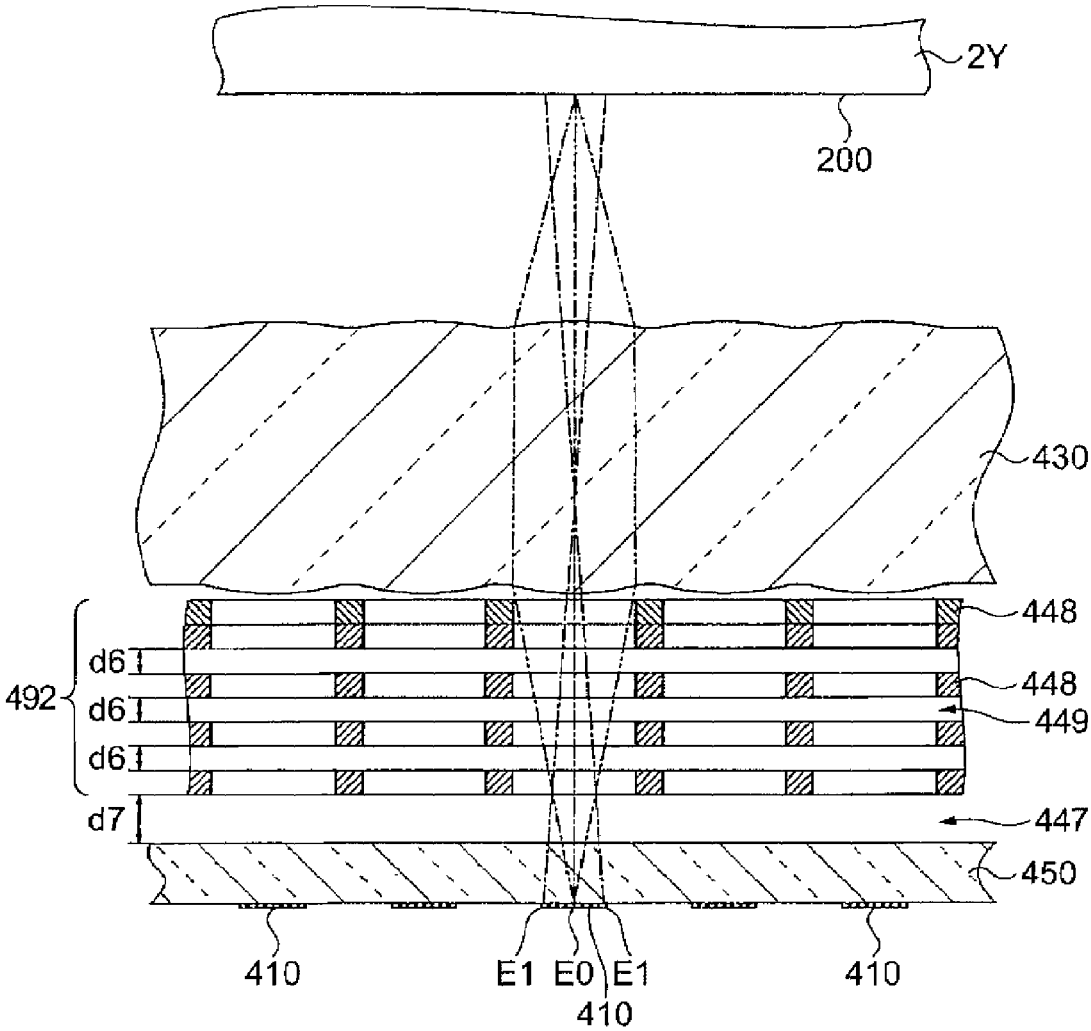
FIG. 13 is a partial enlarged sectional view showing the vicinity of a photosensitive member, a glass substrate, a light shielding member and a microlens array according to the third embodiment of the invention.

An image forming apparatus and a line head according to this embodiment differ from those of the first embodiment in the construction of the light shielding member, but the other constructions thereof are the same as in the first embodiment. FIG. 13 is a partial enlarged sectional view showing the vicinity of a photosensitive member 2Y, a glass substrate 450, a light shielding member 492 and a microlens array 430 according to the third embodiment of the invention. In FIG. 13, the light shielding member 492 of this embodiment includes five light shielding plates. The light shielding plates 448 have the same thickness, and the two light shielding plates 448 closest to the microlens array 430 are bonded to each other. Thicknesses d6 of space layers 449 between the light shielding plates 448 are equal, that is, the light shielding plates 448 are arranged at equal intervals. On the other hand, thickness d7 of a space layer 447 between the light shielding plate 448 facing the glass substrate 450 and the glass substrate 450 is larger than the thickness d6. The other construction of the light shielding member 492 is the same as in the first embodiment.

This embodiment has the following effect. (9) The light shielding member 492 can be formed using the light shielding plates 448 having the same thickness and the same light guide holes, which enables the light shielding member 492 easily producible and having lower production cost to be obtained.

Fifth Embodiment

Figure 14:
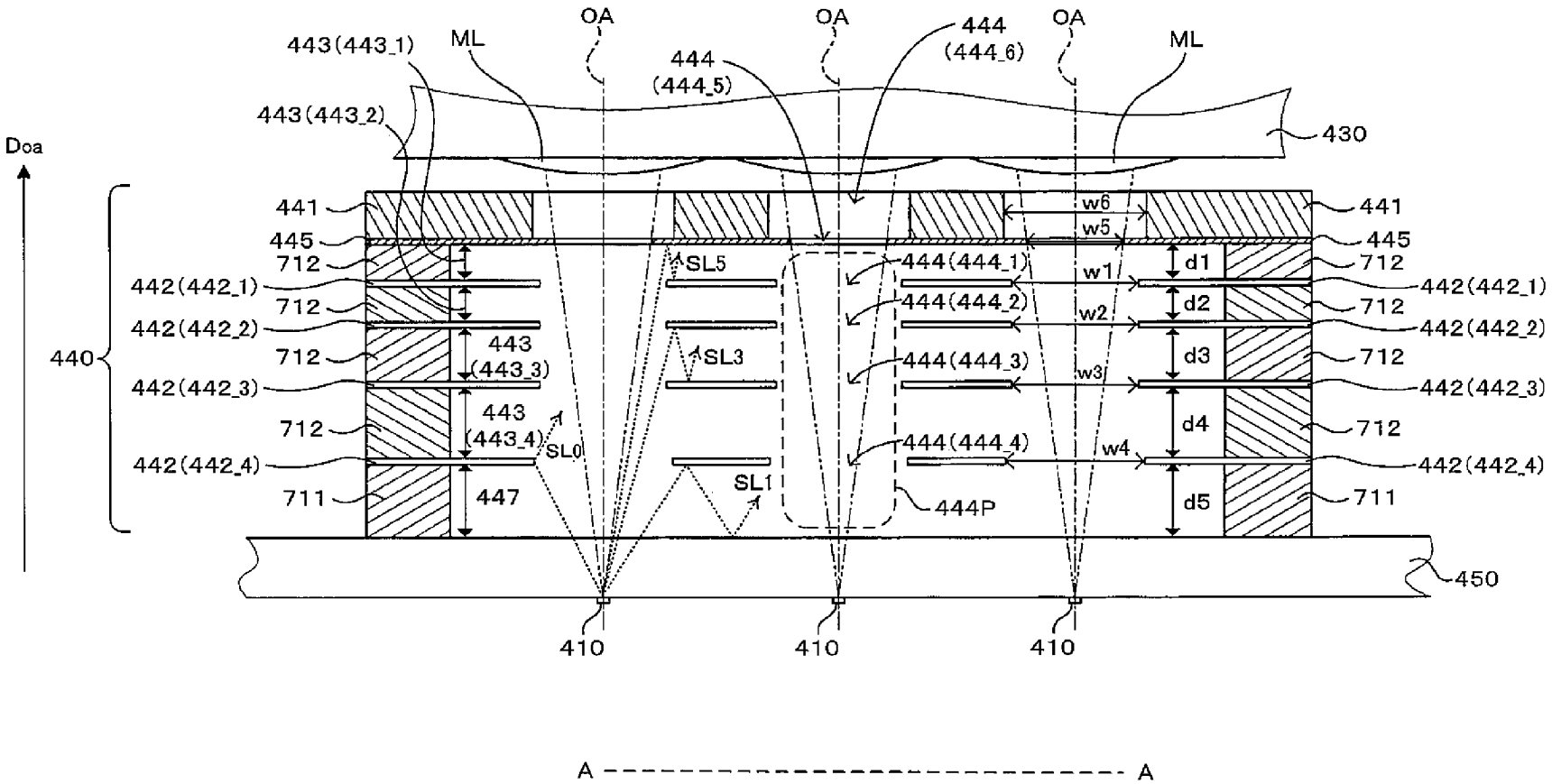
FIG. 14 is a partial sectional view of a line head according to a fifth embodiment of the invention.

FIG. 14 is a partial sectional view of a line head according to a fifth embodiment of the invention. FIG. 14 corresponds to a sectional view taken on line A-A of the line head shown in FIGS. 3 and 7. Specifically, in a line head 4Y or the like of this embodiment, a light emitting element group row is comprised of three light emitting element groups 410 (for instance, light emitting element groups 410A2, 410B2 and 410C2) arranged at mutually different positions in the sub scanning direction YY, and the three light emitting element groups 410 are mutually displaced by pitches P in the main scanning direction XX. As a result, an arrangement direction A-A of the three light emitting element groups 410 in the light emitting element group row is inclined with respect to the sub scanning direction YY. Accordingly, in FIG. 14, a section of the line head 4Y or the like taken on such a line A-A is shown.

As shown in FIG. 14, the light emitting element groups 410 as groups of a plurality of light emitting elements 411 are formed on an under surface of a glass substrate 450 (head substrate). The light emitting elements 411 constituting the light emitting element groups 410 are so-called bottom-emission type organic EL devices formed on the under surface of the glass substrate 450. A microlens array 430 is arranged at a position facing the glass substrate 450 in a light propagating direction Doa (first direction). In the microlens array 430, microlenses ML are arranged at positions facing the light emitting element groups 410 in the light propagating direction Doa. These microlenses ML are arranged to face the corresponding light emitting element groups 410, and light beams emitted from the light emitting element groups 410 are incident on the microlenses ML arranged at the facing positions. It should be noted that the light propagating direction Doa is a direction extending from the light emitting element groups 410 toward the microlenses ML and normal or substantially normal to the main scanning direction XX and the sub scanning direction YY.

A light shielding member 440 is disposed between the glass substrate 450 and the microlens array 430. In this light shielding member 440, light shielding plates 442, 445 are arranged to face the glass substrate 450. The four light shielding plates 442 (442_1, 442_2, 442_3, 442_4) and the light shielding plate 445 are arranged side by side in the light propagating direction Doa. Specifically, these light shielding plates 442, 445 are arranged in the order of 442_4, 442_3, 442_2, 442_1 and 445 from the glass substrate 450. Black plating is applied to the surfaces of these light shielding plates 442, 445 to form antireflection layers for suppressing light reflections. Space layer defining members 712 are interposed between the respective light shielding plates 442, 445. The space layer defining members 712 are provided at the opposite ends with respect to an A-A direction (that is, sub scanning direction YY), and the thicknesses of space layers 443 between the respective light shielding plates 442, 445 in the light propagating direction Doa are specified by the space layer defining members 712. In other words, in this embodiment, the light shielding plates 442, 445 are arranged side by side in the light propagating direction Doa while defining the space layers 443 therebetween. Thicknesses d1, d2, d3 and d4 of the respective space layers 443 in the light propagating direction Doa satisfy the following relationship:

$$d1<d2<d3<d4.$$

The closer the space layer 443 is to the glass substrate 450, the larger the thickness is.

Gap defining members 711 are interposed between the glass substrate 450 and the light shielding plates 442_4 closest to the glass substrate 450 out of the plurality of light shielding plates 442, 445. The gap defining members 711 are provided at the opposite ends with respect to the A-A direction (that is, sub scanning direction YY). The gap defining members 711 specifies thickness d5 of a gap 447 between the light shielding plate 442_4 and the glass substrate 450 in the light propagating direction Doa. The thickness of the gap 447 is larger than the thicknesses d1 to d4 of the respective space layers 443. In this way, a recess is formed as a space enclosed by the light shielding plate 442_4 and the gap defining members 711 and open toward the glass substrate 450 in this embodiment. The depth of this recess is equivalent to the thickness d5 of the gap 447.

A light shielding plate 441 is disposed between the light shielding plate 445 and the microlens array 430. This light shielding plate 441 is arranged in contact with the light shielding plate 445 in the light propagating direction Doa.

As described above, the respective light shielding plates 442, 445, 441 are arranged such that the thickness directions thereof are parallel to or substantially parallel to the light propagating direction Doa. Light guide holes 444 are formed to penetrate the respective light shielding plates 442, 445, 441 thus arranged in the direction Doa. The light guide holes 444 are formed corresponding to the respective light emitting element groups 410 and face the light emitting element groups 410 in the light propagating direction Doa. Accordingly, the respective light guide holes 444 formed corresponding to the same light emitting element group 410 are arranged side by side in the light propagating direction Doa. Specifically, the respective light guide holes are arranged in the order of 444_4, 444_3, 444_2, 444_1, 444_5 and 444_6 from the light emitting element group 410. Here, the light guide holes 444_4, 444_3, 444_2 and 444_1 are those formed in the light shielding plates 442_4, 442_3, 442_2 and 442_1; the light guide hole 444_5 is the one formed in the light shielding plate 445; and the light guide hole 444_6 is the one formed in the light shielding plate 441. The light guide holes 444_4, 444_3, 444_2, 444_1, 444_5 and 444_6 are arrayed side by side in this way to form a light guide portion 444P. Thus, a light beam emitted from the light emitting element group 410 is incident on the microlens ML through the respective light guide holes 444_4, 444_3, 444_2, 444_1, 444_5 and 444_6 facing this light emitting element group 410 (in other words, through the light guide portion 444P). The respective light guide holes 444 are shaped such that an optical axis OA of the facing microlens ML is a center of symmetry.

Widths w1, w2 and w3 of the respective light guide holes 444_1, 444_2 and 444_3 are set substantially equal. Width w4 of the light guide hole 444_4 is set slightly larger than the widths w1 to w3. Width w5 of the light guide hole 444_5 is set smaller than the widths w1 to w4. Since the width w5 of the light guide hole 444_5 of the light shielding plate 445 is set in this way, the light guide hole 444_5 functions as an aperture stop for narrowing down the incident light on the microlens ML. Width w6 of the light guide hole 444_6 is set sufficiently larger than the width w5 of such a light guide hole 444_5, so that the light beam having passed through the light guide hole 444_5 is not unnecessarily shielded by the light shielding plate 441.

As described above, in the fifth embodiment, the plurality of light shielding plates 442, 445 are arranged side by side in the light propagating direction Doa, and the respective light shielding plates 442, 445 are formed with the light guide holes 444 penetrating in the direction Doa. Further, the plurality of light shielding plates 442, 445 are arranged while defining the space layers 443 therebetween. Accordingly, the incidence of the reflected lights by the light shielding member 440 on the microlenses ML is effectively suppressed. In other words, parts of lights (stray light SL0 in FIG. 14, for instance) reflected by edges 444E of the light guide holes 444 formed in the light shielding plates 442 are incident on the microlenses ML in some cases, but most of lights having entered the space layers 443 without being reflected by the edges 444E of the light guide holes 444 are reflected by the surfaces of the light shielding plates 442 to be attenuated without being incident on the microlenses ML. This is exemplified with reference to FIG. 14. Any of stray lights SL1, SL3 and SL5 enters the space layer 443 without being incident on the edge 444E of the light guide hole 444. Thus, these stray lights SL1, SL3 and SL5 are reflected by the under surfaces of the light shielding plates 442 to reverse their propagating directions, and hence, are reflected again by the top surfaces of the light shielding plates 442 or the top surface of the glass substrate 450. Since the stray lights SL1, SL3 and SL5 are reflected a plurality of times in this way, they are mostly attenuated and are not incident on the microlens ML. As described above, since the space layers 443 are defined between the respective light shielding plates 442, 445 in the fifth embodiment, the incidence of the reflected lights by the light shielding member 440 on the microlenses ML is suppressed, wherefore the influence of stray lights on image formation (ghost and the like) can be suppressed.

As can be understood from the above discussion, the space layers 443 can be said to possess a stray light attenuating function. Accordingly, in light of suppressing the incidence of stray lights on the microlenses ML, it is preferable to cause more stray lights to enter the space layers 443 while reducing stray lights reflected by the edges of the light guide holes 444. Thus, the thicknesses of the space layers 443 between the respective light shielding plates 442, 445 may be five to thirty times as large as those of the light shielding plates 442, 445 in the light propagating direction Doa. By such dimensioning, more stray lights come to enter the space layers 443, whereby the incidence of stray lights on the microlenses ML can be more effectively suppressed.

In the fifth embodiment, the space layer defining members 712 for defining the thickness (d3 for instance) in the direction Doa of the space layer 443 between the two light shielding plates 442, 445 are provided between the two light shielding plates 442, 445 (light shielding plates 442_3, 442_2, for instance) adjacent in the light propagating direction Doa. Therefore, the fifth embodiment is preferable since the thicknesses of the space layers 443 can be set with high accuracy only by adjusting the thicknesses of the space layer defining members 712.

In the fifth embodiment, the gap 447 is defined between the glass substrate 450 and the light shielding plate 442_4 closest to the glass substrate 450 (head substrate) in the light propagating direction Doa out of the plurality of light shielding plates 442, 445. Accordingly, it becomes possible to cause more lights to enter the gap 447 while reducing stray lights to be reflected by the edges 444E of the light guide holes 444. This is for the following reason.

Figure 15:
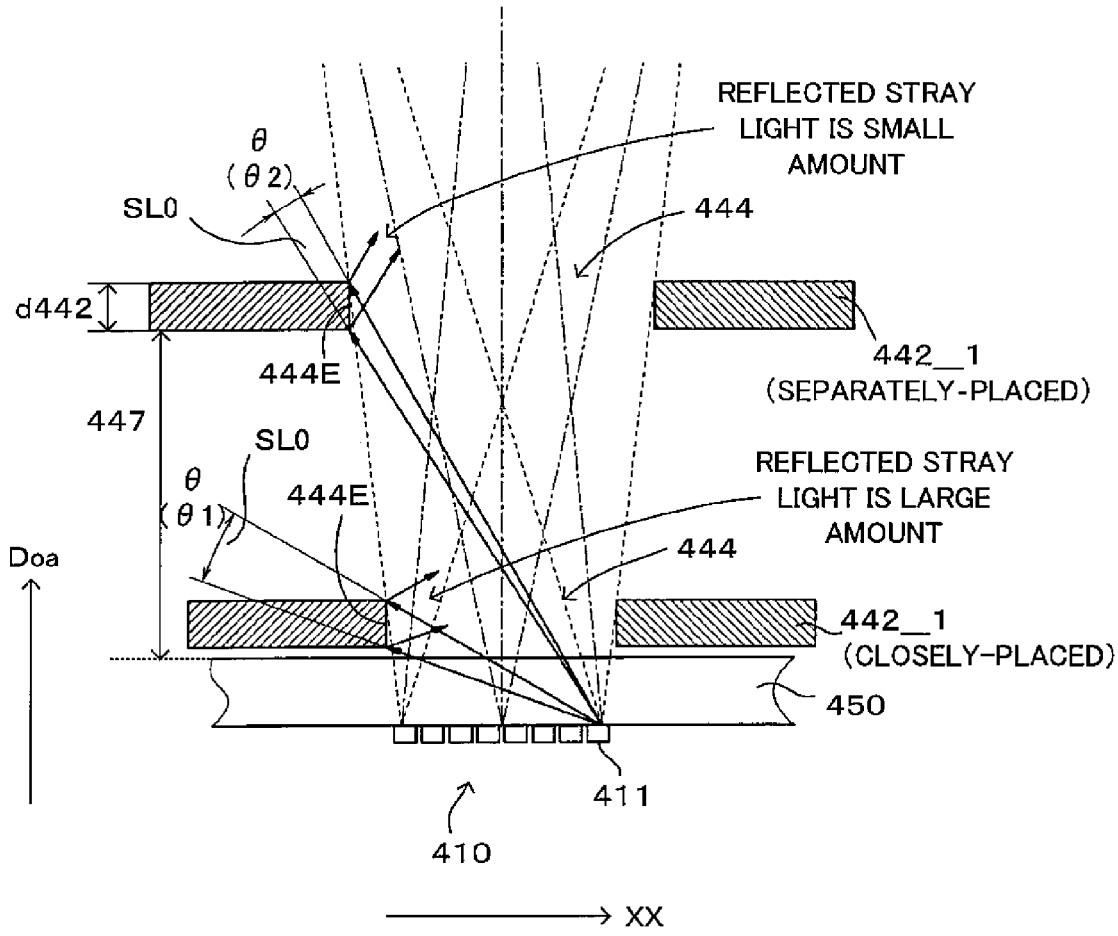
FIG. 15 is a partial sectional view in the main scanning direction showing functions and effects fulfilled by defining the gap.

FIG. 15 is a partial sectional view in the main scanning direction XX showing functions and effects fulfilled by defining the gap. In FIG. 15, a case where the sufficient gap 447 is defined between the light shielding plate 442_1 and the glass substrate 450 (distant arrangement in FIG. 15) and a case where almost no gap 447 is defined (proximate arrangement in FIG. 15) are both drawn for comparison in order to facilitate the understanding of the functions and effects. Here, a stray light SL0 from the light emitting element 411 located at an end of the light emitting element group 410 in the main scanning direction XX is considered. As is clear from FIG. 15, when an angle of viewing the edge 444E of the light guide hole 444 from the light emitting element 411 is a viewing angle θ, the relationship between a viewing angle θ1 in the case of the proximate arrangement and a viewing angle θ2 in the case of the distant arrangement is θ1>θ2. Here, the viewing angle θ is equivalent to an angle defined between two lines extending from the center of the light emitting element 411 and passing the ends of the edge 444E of the light guide hole 444 in the direction Doa defining thickness d442. Specifically, when the light shielding plate 442_1 is arranged distant from the glass substrate 450, the viewing angle θ is smaller as compared to the case of the proximate arrangement, wherefore the amount of the stray light SL0 reflected by the edge 444E of the light guide hole 444 is suppressed. In other words, by defining the gap 447, it becomes possible to cause more light to enter the gap 447 while reducing the amount of the stray light SL0 to be reflected by the edge 444E of the light guide hole 444. Similar to lights having entered the space layers 443, lights having entered the gap 447 are mostly reflected by the surface of the light shielding plate 442 to be attenuated without being incident on the microlenses ML. Therefore, the incidence of stray lights reflected by the light shielding member 440 on the microlenses ML can be more effectively suppressed.

In the fifth embodiment, the gap defining members 711 for defining the thickness d5 of the gap 447 in the light propagating direction Doa are provided between the glass substrate 450 and the light shielding plate 442_4 closest to the glass substrate 450 in the direction Doa. Accordingly, the thickness d5 of the gap 447 can be set with high accuracy only by adjusting the thickness of the gap defining members 711, and hence, the fifth embodiment is preferable.

In the fifth embodiment, the thickness d5 of the gap 447 in the light propagating direction Doa is larger than the thicknesses d1 to d4 of the space layers 443 and the gap 447 has the sufficient thickness d5. Accordingly, it becomes possible to cause more light to enter the gap 447 while reducing the amount of the stray light SL0 to be reflected by the edge 444E of the light guide hole 444, and the incidence of stray lights reflected by the light shielding member 440 on the microlenses ML can be more effectively suppressed.

In the fifth embodiment, the light shielding member 440 includes three or more light shielding plates 442, 445 arranged side by side in the light propagating direction Doa. The closer the space layers 443 between the respective light shielding plates 442, 445 are to the glass substrate 450 in the direction Doa, the larger thicknesses the space layers 443 have in the direction Doa. Accordingly, it becomes possible to efficiently introduce stray lights to the space layers 443 relatively distant from the microlenses ML. Thus, the stray lights can be reflected by the surfaces of the light shielding plates 442 relatively distant from the microlenses ML to be attenuated. Therefore, the incidence of stray lights reflected by the light shielding member 440 on the microlenses ML can be more effectively suppressed.

In the fifth embodiment, the antireflection layers for suppressing light reflections are formed on the surfaces of the light shielding plates 442, 445. Accordingly, stray lights can be more reliably attenuated. Further, these antireflection layers are made with black platings. Therefore, the antireflection layers can be more easily formed, thereby enabling a simpler production process for the line head 40Y and the like and a cost reduction for the line head 40Y and the like.

In the fifth embodiment, the light emitting elements 411 are organic EL devices. Such organic EL devices have smaller light amounts as compared to LEDs and the like. Further, bottom-emission type organic EL devices as used in the above embodiment tend to further reduce light amounts. Therefore, it is preferable to maximally suppress the influence of stray lights on images by applying the invention to the line head 40Y and the like including such light emitting elements 411.

Sixth Embodiment

Figure 16:
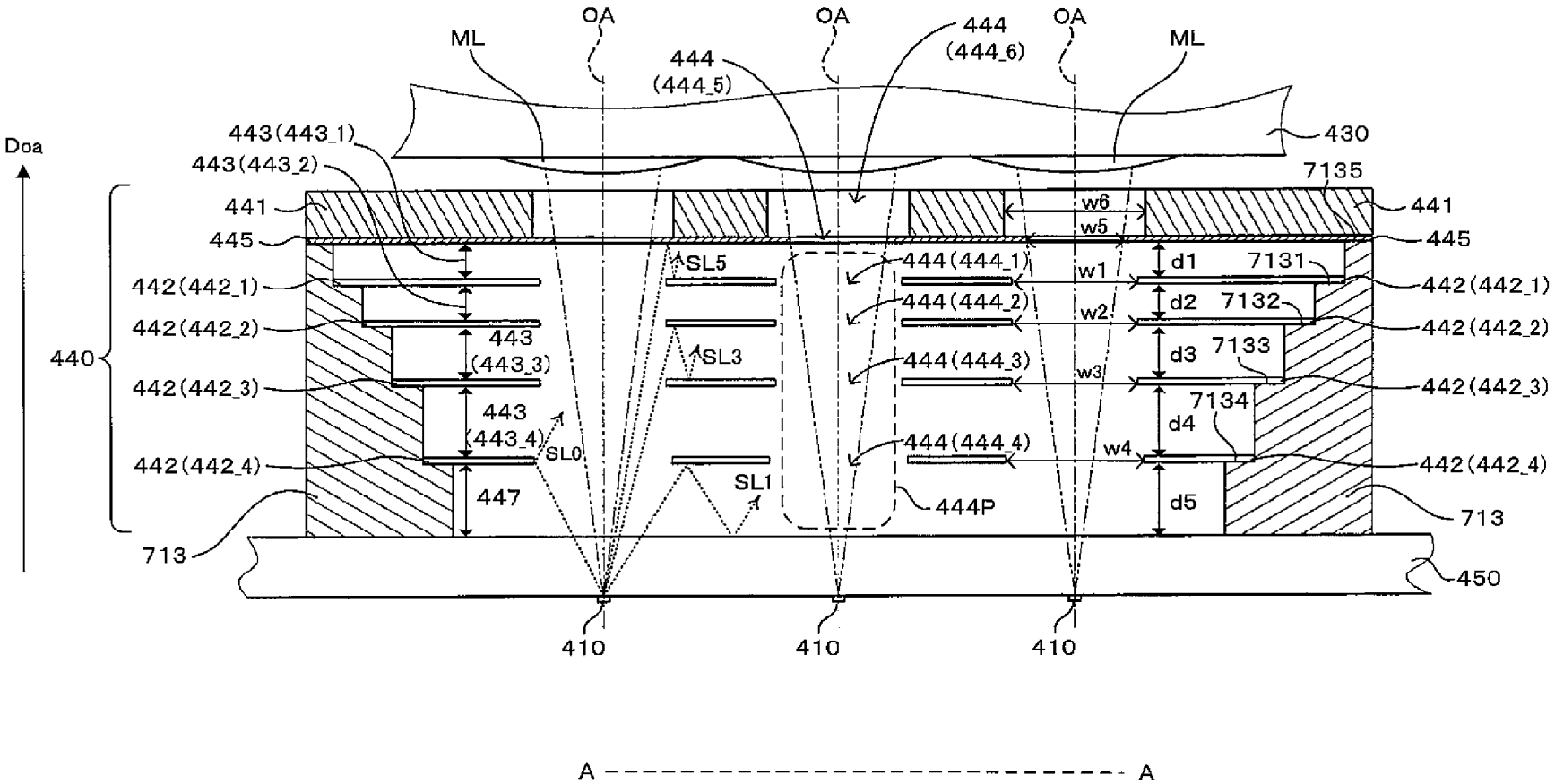
FIG. 16 is a partial sectional view of a line head according to a sixth embodiment of the invention.

FIG. 16 is a partial sectional view of a line head according to a sixth embodiment of the invention. FIG. 16 corresponds to a sectional view taken on line A-A of the line head shown in FIGS. 3 and 7. Points of difference from the above fifth embodiment are mainly described below, and common parts are not described by being identified by the same reference numerals. In the sixth embodiment, the gap defining members 711 and the space layer defining members 712 are not provided and, instead, outer frames 713, 713 are provided at the opposite ends of the line A-A. These outer frames 713, 713 face inwardly each other, and the inner side of each outer frame 713 has a stepped configuration including five steps 7131 to 7135. Each of light shielding plates 442, 445 is placed on the corresponding two facing steps. In other words, the light shielding plate 442_1 is placed on the two facing steps 7131, 7131, and the light shielding plates 442, 445 are similarly placed on the other pairs of steps 7132, 7132, etc.

Since the light shielding plates 442, 445 are placed on the stepped outer frames 713, 713 in this way, the plurality of light shielding plates 442, 445 are arranged while defining space layers 443 therebetween and a gap 447 is defined between the light shielding plate 442_4 and a glass substrate 450. As described above, in the sixth embodiment, a recess is formed as a space enclosed by the light shielding plate 442_4 and the outer frames 713, 713 and open toward the glass substrate 450 and the depth of this recess is equivalent to thickness d5 of the gap 447. The thicknesses of the space layers 443 and the gap 447 are specified by the heights of the respective steps 7131 to 7135.

As described above, since the space layers 443 are defined between the respective light shielding plates 442, 445 in the sixth embodiment as well, the incidence of lights reflected by the light shielding member 440 on the microlenses ML is suppressed, wherefore the influence (ghost and the like) of stray lights on image formation can be suppressed.

The gap 447 is defined between the light shielding plate 442_4 and the glass substrate 450. Accordingly, it becomes possible to cause more light to enter the gap 447 while reducing the amount of stray lights to be reflected by edges 444E of light guide holes 444.

Miscellaneous

The invention is not limited to the embodiments and modifications described above, and various other changes can be made without departing from the gist of the invention. For example, in the above embodiments, the light emitting element groups 410 are two dimensionally arranged such that three light emitting element group rows L411 (group rows), in each of which a specified number (two or more) of light emitting element groups 410 are aligned in the main scanning direction XX, are arranged in the sub scanning direction YY. However, the arrangement mode of the plurality of light emitting element groups 410 is not limited to this and can be suitably changed.

In the above embodiments, a plurality of spots are formed side by side along a straight line in the main scanning direction XX as shown in FIG. 7 using the line head according to the invention. However, such a spot forming operation is only an example of the operation of the line head according to the invention, and operations executable by the line head are not limited to this. In other words, spots to be formed need not be formed side by side along a straight line in the main scanning direction XX and, for example, may be formed side by side along a line at a specified angle to the main scanning direction XX or may be formed in a zigzag or wavy manner.

Although the present invention is applied to the color image forming apparatuses in the above respective embodiments and modifications, the application subject of the invention is not limited to this and the invention is also applicable to monochromatic image forming apparatuses for forming so-called monochromatic images. Further, the invention is applicable not only to image forming apparatuses using the liquid toner in which toner particles are dispersed in the nonvolatile liquid carrier, but also to image forming apparatuses using a dry toner.

Although the bottom-emission type organic EL devices are used as the light emitting elements 411 in the above embodiment, devices usable as the light emitting elements 411 are not limited to this. In other words, top-emission type organic EL devices or LEDs can be used as the light emitting elements 411.

In the above embodiments, two light emitting element rows L411 comprised of four light emitting elements 411 are arranged in the sub scanning direction YY to form one light emitting element group 410. However, the number of the light emitting element rows L411 and the number of the light emitting elements 411 constituting the light emitting element row L411 are not limited to these.

Although the three light emitting element group rows L410 are arranged in the sub scanning direction YY in the above embodiments, the number of the light emitting element group rows L410 is not limited to this.

In the embodiment shown in FIG. 12, lights necessary for exposure are effectively introduced to the microlenses ML by forming the respective light guide holes 444 arranged opposed to the light emitting element groups 410 such that the closer the light guide holes 444 are to the light emitting element groups 410 in the light propagating direction Doa, the larger widths the light guide holes have (that is, w1<w2<w3<w4). However, such width setting of the light guide holes 444 is not essential to the invention and can be suitably changed.

In other words, a preferable embodiment of a line head is a line head, comprising: a head substrate that includes a plurality of light emitting element groups as groups of light emitting elements; a lens array that includes a plurality of lenses each of which faces the corresponding light emitting element group in a first direction; and a light shielding member that is disposed between the head substrate and the lens array and includes a plurality of light shielding plates which are arranged side by side in the first direction while defining a space layer therebetween, wherein each of the plurality of light shielding plates is provided with a plurality of light guide holes penetrating in the first direction and facing the plurality of light emitting element groups in the first direction respectively, the plurality of light guide holes facing each of the light emitting element groups are arranged in the first direction respectively to form a plurality of light guide portions, and lights from the plurality of light emitting element groups are incident on the plurality of lenses through the plurality of light guide portions respectively.

In still other words, a preferable embodiment of an image forming apparatus is an image forming apparatus, comprising: a latent image carrier; and a line head that includes: a head substrate which has a plurality of light emitting element groups as groups of light emitting elements; a lens array which has a plurality of lenses each of which faces the corresponding light emitting element group in a first direction; and a light shielding member which is disposed between the head substrate and the lens array and has a plurality of light shielding plates which are arranged side by side in the first direction while defining a space layer therebetween, wherein the line head images lights emitted from the light emitting elements using the lenses to expose a surface of the latent image carrier, each of the plurality of light shielding plates is provided with a plurality of light guide holes penetrating in the first direction and facing the plurality of light emitting element groups in the first direction respectively, the plurality of light guide holes facing each of the light emitting element groups are arranged in the first direction respectively to form a plurality of light guide portions, and lights from the plurality of light emitting element groups are incident on the plurality of lenses through the plurality of light guide portions respectively.

In still other words, a preferable embodiment of a light shielding member is a light shielding member, comprising: a plurality of light shielding plates that are provided with light guide holes penetrating in a first direction, and are arranged side by side in the first direction while defining a space layer therebetween such that the respective light guide holes are arranged side by side in the first direction, wherein the plurality of light guide holes that are arranged side by side in the first direction forms a light guide portion, and lights passes through the plurality of light shielding plates in the first direction by way of the light guide portion.

According to the embodiments (line head, image forming apparatus, light shielding member) thus constructed, the plurality of light shielding plates are arranged side by side in the first direction and each of the light shielding plates is provided with the light guide holes penetrating in the first direction. Lights from the light emitting element groups are incident on the lenses through the respective light guide holes formed to face the light emitting element groups. Since the plurality of light shielding plates are arranged while defining the space layer therebetween in the embodiments, the incidence of the reflected lights by the light shielding member on the lenses can be effectively suppressed. Specifically, although parts of the lights reflected by the edges of the light guide holes formed in the light shielding plates are incident on the lenses in some cases, most of the lights having entered the space layer without being reflected by the edges of the light guide holes are reflected by the surfaces of the light shielding plates to be attenuated without being incident on the lenses. Therefore, the incidence of the reflected lights by the light shielding member on the lenses is suppressed and the influence (ghost and the like) of stray lights on image formation can be suppressed.

A thickness of the space layer between the respective light shielding plates in the first direction may be five to thirty times as large as that of the light shielding plates. This is because the incidence of the reflected lights by the light shielding member on the lenses is more effectively suppressed in the case of such a construction.

A space layer defining member may be arranged between the two light shielding plates adjacent in the first direction to define a thickness of the space layer between the two light shielding plates in the first direction. This is because the thickness of the space layer can be set with high accuracy by including the space layer defining member in such a way.

A gap may be defined between the head substrate and the closest one of the plurality of light shielding plates to the head substrate in the first direction. In the case of such a construction, it becomes possible to cause more light to enter the gap while reducing the lights to be reflected by the edges of the light guide holes. Similar to the light having entered the space layer, the light having entered the gap is mostly reflected by the surface of the light shielding plate to be attenuated without being incident on the lenses. Therefore, the incidence of the reflected lights by the light shielding member on the lenses is more effectively suppressed.

A gap defining member may be arranged between the light shielding plate closest to the head substrate in the first direction and the head substrate for defining the thickness of the gap in the first direction. This is because the thickness of the gap can be set with high accuracy by including the gap defining member in this way.

The thickness of the gap may be larger than the thickness of the space layer in the first direction. Since a sufficient thickness can be ensured for the gap by such a construction, it becomes possible to cause more light to enter the gap while reducing the lights to be reflected by the edges of the light guide holes. Therefore, the incidence of the reflected lights by the light shielding member on the lenses is more effectively suppressed.

The light shielding member may include three or more light shielding plates arranged side by side in the first direction, and may be constructed such that the closer the space layers between the respective light shielding plates are to the head substrate in the first direction, the larger thicknesses in the first direction the space layers have. It becomes possible to efficiently introduce stray lights into the space layers comparatively distant from the lenses by such a construction.

Accordingly, it is possible to reflect the stray lights by the surfaces of the light shielding plates disposed comparatively distant from the lenses so that the stray lights are attenuated. Hence, the incidence of the reflected lights by the light shielding member on the lenses is more effectively suppressed.

The construction may be such that the closer the respective light guide holes provided to face the light emitting element groups are to the light emitting element groups in the first direction, the larger widths the light guide holes have. Since light necessary for exposure can be effectively introduced to the lenses by such a construction, a satisfactory exposure is possible.

An antireflection layer for suppressing light reflections may be provided on a surface of each of the light shielding plates. This is because stray lights can be more reliably attenuated by such a construction.

Further, the antireflection layer may be made with black plating. This is because the antireflection layers can be more easily formed by such a construction and it becomes possible to simplify a line head production process and to reduce the cost of the line head.

The light emitting elements may be organic EL devices. Further, the organic EL devices may be of the bottom-emission type. In other words, the organic EL devices have smaller light amounts as compared with LEDs and the like. Particularly, the organic EL devices of the bottom emission type tend to have even smaller light amounts. Therefore, for these constructions, it is suitable to maximally suppress the influence of stray lights on images as described above by applying the embodiments.

A light shielding member of an embodiment comprises a plurality of light shielding plates, wherein a plurality of light guide holes are formed in the light shielding plates in a thickness direction of the light shielding plates, and the light shielding plates are placed one over another with space layers therebetween such that the light guide holes communicate with each other.

According to this embodiment, lights having entered the communicating light guide holes of the light shielding member are reflected only by inner surfaces of the light guide holes formed in the plurality of light shielding plates. On the other hand, the lights having propagated toward the space layers between the light shielding plates are reflected in directions toward an incidence side by the light shielding plates. Further, the lights having propagated toward the space layers between the light shielding plates are attenuated through a plurality of reflections. Therefore, there can be obtained a light shielding member with a reduced production of stray lights to pass therethrough by reflection.

In an embodiment, thicknesses of the space layers are preferably five to thirty times as large as that of the light shielding plates. Since the thicknesses of the space layers are five to thirty times as large as the height of the inner surfaces of the light guide holes formed in the thickness direction of the light shielding plates in this embodiment, the amount of the lights reflected by the inner surfaces of the light guide holes is smaller than that of the lights propagating toward the space layers. Therefore, there can be obtained a light shielding member with a reduced production of stray lights to pass therethrough.

In an embodiment, the light shielding member is preferably such that a recess is formed in either of the outermost ones of the light shielding plates placed one over another. In this embodiment, more light incident from the side of the recess propagates toward the recess, wherefore the reflection by the inner surfaces of the light guide holes is more suppressed.

In an embodiment, a depth of the recess is preferably larger than the thicknesses of the space layers. In this embodiment, the reflected light amount per unit area of the lights reflected by the inner surfaces of the light guide holes near a light incident side is larger than the reflected light amount by the inner surfaces of the light guide holes distant from the light incident positions. Since the depth of the recess is larger than the thicknesses of the space layers, more lights incident from the side of the recess propagates toward the recess. Therefore, there can be obtained a light shielding member with a reduced production of stray lights to pass therethrough.

In an embodiment, the thicknesses of the space layers defined between the light shielding plates preferably become larger toward the recess. Since the thicknesses of the space layers become larger toward the recess in this embodiment, the amount of the lights incident from the side of the recess and propagating toward the space layers increases. Therefore, there can be obtained a light shielding member with a reduced production of stray lights to pass therethrough.

In an embodiment, the sizes of the light guide holes formed in the light shielding plates preferably become larger toward the recess. In this embodiment, more light incident from the side of the recess is introduced and the reflection of the light incident from the side of the recess is more suppressed.

A line head of an embodiment comprises: a substrate; a plurality of light emitting element groups each of which includes a plurality of light emitting elements and which are discretely arranged on the substrate; a plurality of imaging lenses which are arranged to face the light emitting element groups in a one-to-one correspondence and are adapted to image lights emitted from the plurality of light emitting elements belonging to the facing light emitting element groups on a surface-to-be-scanned; and a light shielding member which is disposed between the substrate and the imaging lenses and includes a plurality of light shielding plates, wherein each of the light shielding plates is provided with a plurality of light guide holes formed in a thickness direction of the light shielding plate, and the plurality of light shielding plates are placed one over another with space layers therebetween such that the imaging lenses are communicated with the facing light emitting element groups through the light guide holes.

According to this embodiment, the lights emitted from the light emitting elements enter the communicating light guide holes of the light shielding member and are reflected by inner surfaces of the light guide holes formed in the plurality of light shielding plates. On the other hand, lights having propagated toward the space layers between the light shielding plates are reflected in directions toward an incidence side. Further, the lights having propagated toward the space layers between the light shielding plates are attenuated through a plurality of reflections. Therefore, less stray light to be reflected by the inner surfaces of the light guide holes and to pass the light shielding member is produced and there can be obtained a line head with a reduced occurrence of ghost caused by stray lights incident on the imaging lenses.

In an embodiment, the thicknesses of the space layers are preferably five to thirty times as large as that of the light shielding plates. Since the light shielding member having the above effects is included in this embodiment, there can be obtained a line head capable of better accomplishing the above effects.

In an embodiment, the light shielding plates are preferably provided with a recess formed on a surface of the light shielding plate facing the substrate. Since the light shielding member having the above effects is included in this embodiment, there can be obtained a line head capable of better accomplishing the above effects.

In an embodiment, a depth of the recess is preferably larger than the thicknesses of the space layers. Since the light shielding member having the above effects is included in this embodiment, there can be obtained a line head capable of better accomplishing the above effects.

In an embodiment, thicknesses of the space layers defined between the light shielding plates preferably become larger toward the recess. Since the light shielding member having the above effects is included in this embodiment, there can be obtained a line head capable of better accomplishing the above effects.

In an embodiment, sizes of the light guide holes formed in the light shielding plates preferably become larger toward the recess. Since the light shielding member having the above effects is included in this embodiment, there can be obtained a line head capable of better accomplishing the above effects.

An image forming apparatus of an embodiment comprises: a latent image carrier whose surface is conveyed in a sub scanning direction; and an exposing unit which has the same construction as the above line head and forms spots on the surface of the latent image carrier as a surface-to-be-scanned.

According to this embodiment, since the image forming apparatus comprises the line head as the exposing unit capable of accomplishing the above effects, spots with a reduced occurrence of ghost are formed on the surface of the latent image carrier as the surface-to-be-scanned. Therefore, there can be obtained an image forming apparatus capable of forming clear latent images and having a smaller reduction in image quality.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A line head, comprising:

a head substrate that includes a plurality of light emitting element groups as groups of light emitting elements;

a lens array that includes a plurality of lenses each of which faces the corresponding light emitting element group in a first direction; and a light shielding member that is disposed between the head substrate and the lens array and includes a plurality of light shielding plates which are arranged side by side in the first direction while defining a space layer therebetween, wherein each of the plurality of light shielding plates is provided with a plurality of light guide holes penetrating in the first direction and facing the plurality of light emitting element groups in the first direction respectively, the plurality of light guide holes facing each of the light emitting element groups are arranged in the first direction respectively to form a plurality of light guide portions, lights from the plurality of light emitting element groups are incident on the plurality of lenses through the plurality of light guide portions respectively, a gap is defined between the head substrate and the light shielding plate closest to the head substrate in the first direction out of the plurality of light shielding plates, thicknesses of the gap and the space layers become smaller with distance from the head substrate, among the gap and the space layers, the space layer between the light shielding plate closest to the lens array and the light shielding plate second-closest to the lens array has the smallest thickness, and among the gap and the space layers, the gap has the largest thickness.

2. The line head according to claim 1, wherein the thickness of the space layer between the respective light shielding plates in the first direction is five to thirty times as large as that of the light shielding plates.

3. The line head according to claim 1, comprising a space layer defining member that is arranged between the two light shielding plates adjacent in the first direction to define the thickness of the space layer between the two light shielding plates in the first direction.

4. The line head according to claim 1, comprising a gap defining member that is arranged between the head substrate and the light shielding plate closest to the head substrate in the first direction to define the thickness of the gap in the first direction.

5. The line head according to claim 1, wherein, out of the light guide holes which face the light emitting element groups, the closer the light guide holes are to the light emitting element groups in the first direction, the larger widths the light guide holes have.

6. The line head according to claim 1, comprising an antireflection layer that is provided on a surface of each of the light shielding plates to suppress light reflection.

7. The line head according to claim 6, wherein the antireflection layer is made with black plating.

8. The line head according to claim 1, wherein the light emitting elements are organic EL devices.

9. The line head according to claim 8, wherein the organic EL devices are of the bottom-emission type.

10. An image forming apparatus, comprising:

a latent image carrier; and a line head that includes:

a head substrate which has a plurality of light emitting element groups as groups of light emitting elements;

a lens array which has a plurality of lenses each of which faces the corresponding light emitting element group in a first direction; and a light shielding member which is disposed between the head substrate and the lens array and has a plurality of light shielding plates which are arranged side by side in the first direction while defining a space layer therebetween, wherein the line head images lights emitted from the light emitting elements using the lenses to expose a surface of the latent image carrier, each of the plurality of light shielding plates is provided with a plurality of light guide holes penetrating in the first direction and facing the plurality of light emitting element groups in the first direction respectively, the plurality of light guide holes facing each of the light emitting element groups are arranged in the first direction respectively to form a plurality of light guide portions, lights from the plurality of light emitting element groups are incident on the plurality of lenses through the plurality of light guide portions respectively, a gap is defined between the head substrate and the light shielding plate closest to the head substrate in the first direction out of the plurality of light shielding plates, thicknesses of the gap and the space layers become smaller with distance from the head substrate, among the gap and the space layers, the space layer between the light shielding plate closest to the lens array and the light shielding plate second-closest to the lens array has the smallest thickness, and among the gap and the space layers, the gap has the largest thickness.

11. A light shielding member, comprising:

a plurality of light shielding plates that are provided with light guide holes penetrating in a first direction, and are arranged side by side in the first direction while defining a space layer therebetween such that the respective light guide holes are arranged side by side in the first direction, wherein the plurality of light guide holes that are arranged side by side in the first direction forms a light guide portion, light passes through the plurality of light shielding plates in the first direction by way of the light guide portion, the plurality of light shielding plates are arranged in the first direction from a first light shielding plate to a last light shielding plate, thicknesses of the space layers become smaller with distance from the first light shielding plate, among the space layers, the space layer between the last light shielding plate and the light shielding plate closest to the last light shielding plate has the smallest thickness, and among the space layers, the space layer between the first light shielding plate and the light shielding plate closest to the first light shielding plate has the largest thickness.

* * * * *